US008434469B2

(12) United States Patent
Vandrak

(10) Patent No.: US 8,434,469 B2
(45) **Date of Patent: *May 7, 2013**

(54) GAS-FIRED PORTABLE UNVENTED INFRARED HEATER

(75) Inventor: Brian S. Vandrak, Highland Heights, OH (US)

(73) Assignee: Enerco Group Inc., Cleveland, OH (US)

( * ) Notice: Subject to any disclaimer, the term of this patent is extended or adjusted under 35 U.S.C. 154(b) by 671 days.

This patent is subject to a terminal disclaimer.

(21) Appl. No.: 12/441,462

(22) PCT Filed: Mar. 26, 2007

(86) PCT No.: PCT/US2007/007426

§ 371 (c)(1), (2), (4) Date: Feb. 9, 2010

(87) PCT Pub. No.: WO2007/112089

PCT Pub. Date: Oct. 4, 2007

(65) Prior Publication Data

US 2010/0139651 A1 Jun. 10, 2010

Related U.S. Application Data

(63) Continuation-in-part of application No. 10/518,202, filed on Dec. 16, 2004, now Pat. No. 7,300,278, which is a continuation-in-part of application No. 10/605,486, filed on Oct. 2, 2003, now Pat. No. 6,884,065, which is a continuation-in-part of application No. 10/051,561, filed on Jan. 18, 2002, now Pat. No. 6,648,635, which is a continuation of application No. 09/731,156, filed on Dec. 6, 2000, now Pat. No. 6,340,298.

(60) Provisional application No. 60/743,757, filed on Mar. 24, 2006, provisional application No. 60/169,062, filed on Dec. 6, 1999.

(51) Int. Cl.

| | |
|---|---|
| ***F24C 3/04*** | (2006.01) |
| ***F24H 3/00*** | (2006.01) |
| ***F23N 5/00*** | (2006.01) |
| ***F23N 5/10*** | (2006.01) |

(52) U.S. Cl.
USPC ..... 126/92 B; 126/91 R; 126/92 R; 431/33; 431/80

(58) Field of Classification Search ..... 126/91 R, 126/92 B, 92 R; 431/33, 80
See application file for complete search history.

(56) References Cited

U.S. PATENT DOCUMENTS

| | | | |
|---|---|---|---|
| 1,639,780 | A | 8/1927 | Mulholland |
| 3,139,879 | A | 7/1964 | Bauer et al. |

(Continued)

FOREIGN PATENT DOCUMENTS

| | | |
|---|---|---|
| GB | 253043 | 6/1926 |
| JP | S54-116747 | 9/1979 |

OTHER PUBLICATIONS

O'Meara Camping Centers (web page), Cookers & Heaters, "Alvima Carasol 3b Heater", data sheets pp. 1-7, Jun. 26, 2002.

(Continued)

*Primary Examiner* — Kenneth Rinehart
*Assistant Examiner* — William Corboy
(74) *Attorney, Agent, or Firm* — Brouse McDowell

(57) ABSTRACT

A portable radiant heater supplied by an associated fuel source comprises a housing having a handle for transporting the heater. A plenum in the housing receives fuel from the associated fuel source and mixes the fuel with air. A burner assembly includes a radiant surface that communicates with the plenum. A regulator limits the pressure of the associated propane source to approximately eleven inches water column, and an oxygen depletion system associated with the burner assembly automatically shuts off the heater at a predetermined oxygen content. A tank fitting with a position that can be adjusted relative to the regulator facilitates the installation of the associated fuel source to the heater.

16 Claims, 32 Drawing Sheets

U.S. PATENT DOCUMENTS

| | | | |
|---|---|---|---|
| 3,590,806 | A | 7/1971 | Lock |
| 3,814,573 | A | 6/1974 | Karlovetz |
| D243,694 | S | 3/1977 | Faulkner |
| 4,201,544 | A | 5/1980 | Briggs et al. |
| 4,307,701 | A | 12/1981 | Balon et al. |
| 4,340,362 | A | 7/1982 | Chalupsky et al. |
| 4,348,172 | A | 9/1982 | Miller |
| 4,640,680 | A | 2/1987 | Schilling |
| 4,782,814 | A | 11/1988 | Cherryholmes |
| 4,843,313 | A | 6/1989 | Walton |
| 4,848,313 | A | 7/1989 | Velie |
| 5,090,899 | A | 2/1992 | Kee |
| 5,174,751 | A | 12/1992 | Chapman et al. |
| 5,239,979 | A | 8/1993 | Maurice et al. |
| 5,470,018 | A | 11/1995 | Smith |
| 5,546,925 | A | 8/1996 | Knight et al. |
| 5,628,303 | A | 5/1997 | Ahmady et al. |
| 5,645,043 | A | 7/1997 | Long et al. |
| D391,345 | S | 2/1998 | Mandir et al. |
| 5,807,098 | A | 9/1998 | Deng |
| 5,838,243 | A | 11/1998 | Gallo |
| 5,848,585 | A | 12/1998 | Long et al. |
| 5,865,618 | A | 2/1999 | Hiebert |
| 5,941,699 | A | 8/1999 | Abele |
| 5,984,663 | A | 11/1999 | Joyce |
| D445,889 | S | 7/2001 | Resmo et al. |
| D447,796 | S | 9/2001 | Resmo et al. |
| 6,340,298 | B1 | 1/2002 | Vandrak et al. |
| 6,446,623 | B1 | 9/2002 | Resmo et al. |
| 6,575,154 | B1 | 6/2003 | Freeman et al. |
| 6,619,281 | B2 | 9/2003 | Resmo et al. |
| 6,648,635 | B2 | 11/2003 | Vandrak et al. |
| 6,742,814 | B2 | 6/2004 | Resmo et al. |
| 6,792,937 | B2 | 9/2004 | Resmo et al. |
| 6,843,244 | B2 | 1/2005 | McCalley et al. |
| 2005/0257786 | A1* | 11/2005 | Vandrak et al. ..... 126/91 R |

OTHER PUBLICATIONS

Dynamx Incorporated Warehouse Appliance (web page), Williams Heaters—Vent-Free Honts,,.. Models, data sheets pp. 1-4, Jun. 26, 2002.

AGA, American Gas Association, Fact Sheet, "Oxygen Depletion Sensing (ODS) Systems":/ Dec. 1984.

Bullfinch (Gas Equipment) Limited, The Simba Range Ultra Safe-Low Cost Mobile Cabinet Heaters, 2 pages, undated.

Brians of Sheerness, Valor Fires, data sheets pp. 1-2, Mar. 6, 2002.

Mobil Mobile Gas Supplies, Thurcroft Stove, data sheets pp. 1-2, Mar. 6, 2002. e Gas Supplies, Thurcroft Stove, data sheets pp. 1-2.

The Coleman Co., Inc., 3000 BTU Propane Catalytic Heater, instructions for use pp. 1-4, undated.

Mobile Gas Supplies, Mobile Heaters, data sheets pp. 1-4, Mar. 6, 2002.

Notification of Transmittal of the International Search Report and the Written Opinion of the International Searching Authority dated Jun. 14, 2005.

* cited by examiner

GAS-FIRED PORTABLE UNVENTED INFRARED HEATER

CROSS-REFERENCE TO RELATED APPLICATIONS

This application claims the benefit of, and is a continuation-in-part of, U.S. patent application Ser. No. 10/518,202, filed Sep. 30, 2004, which is a continuation-in-part of U.S. patent application Ser. No. 10/605,486, filed Oct. 2, 2003, which is a continuation-in-part of U.S. patent application Ser. No. 10/051,561, filed Jan. 18, 2002, which is a continuation application of U.S. patent application Ser. No. 09/731,156 filed on Dec. 6, 2000, now U.S. Pat. No. 6,340,298, which is a non-provisional patent application of U.S. patent application Ser. No. 60/169,062, filed Dec. 6, 1999. This following application also claims the benefit of U.S. Provisional Application No. 60/743,757, filed on Mar. 24, 2006.

BACKGROUND OF THE INVENTION

1. Field of the Invention

This invention relates generally to improved portable heaters used in relatively small enclosures. More particularly, the invention relates to a uniquely configured propane source infrared heater for use in enclosures such as small recreational enclosures, temporary work enclosures, or vehicles. Although the invention was designed for indoor areas, it will be appreciated that it has broader applications and may be advantageously employed in a wide variety of environments without departing from the scope of the invention.

2. Description of Related Art

Gas-fired portable heaters are well known in the art and are used in multiple environments. The heater typically includes a housing having a chamber. The housing has an inlet for receiving air into the chamber. Gas is introduced into the chamber to be mixed with the air in order to complete combustion and provide an infrared heating surface. A plenum directs the heat toward a mesh screen and evenly distributes it over the surface thereof. The overall goal in designing such a unit is to achieve a radiant surface that provides even, stable heating over the entire surface.

The use of such heaters is strictly regulated for outdoor only use due to the emission of carbon monoxide. Prior designs in existing portable units are subject to a wide variety of problems. Most importantly, the prior designs are not safe or certified to operate in small recreational enclosures such as tents, truck-caps, fishing huts, trailers, vans, etc. There are a few reasons why the devices found in the prior art are not adequate to perform in such environments. First, the portable heaters that exist today operate at a high pressure generally on the order of 12 psi. Specifically, the pressure from the propane tank through a regulator is necessarily high in order to achieve adequate gas and air flow. In addition to requiring high pressure, previous designs do not have the ability to pass strict combustion requirements at a high and low firing condition and at a reduced pressure. For example, a new standard developed for this product (CSA International 4.98 US) states that "the appliance shall not produce carbon monoxide in excess of 0.010 (100 ppm) percent in a room with no air changes occurring during combustion of the amount of gas necessary to reduce the oxygen content of the room to 18 percent by volume." In addition, they do not possess an oxygen depletion system ("ODS") (Capreci/Part No. 21500). These shortcoming's have prevented the portable heaters found in the prior art from adequately performing in small recreational and temporary work enclosures.

Existing portable units typically combust a fuel such as propane to generate heat. Propane tanks come in a variety of sizes such as a 1 pound tank that can be replaced when the propane fuel is fully consumed. To replace an empty propane tank with a full propane tank, existing heaters require the propane tank to be raised into the connection point of the heater in an upward direction from below to avoid contacting a protective structure that guards the connection between the fuel tank and the heater. In close quarters, this can be difficult to accomplish. As an alternative, the heater can be lifted to facilitate the replacement of an empty propane tank with a new tank. However, lifting the heater to install a replacement propane tank can be cumbersome, and difficult to do with one person.

Attempts have been made to alleviate at least some of the burdens associated with replacing an empty propane tank. Such attempts have typically revolved around a rotatable regulator that can be rotated in order to expose the connection point to establish a direct connection between the propane tank and the regulator. However, repeated rotation of the regulator can subject the regulator to damage from prolonged use, which in turn can cause an undesirable connection between the heater and the propane tank and hamper the ability of the heater to function properly.

Therefore, a need exists to provide a portable infrared heater capable of performing safely in small recreational enclosures and temporary work enclosures that can facilitate ready replacement of a fuel source.

BRIEF SUMMARY OF THE INVENTION

This invention contemplates a new and improved burner assembly that is capable of performing safely in small recreational facilities such as tents, truck-caps, vans, fishing huts, trailers, etc.

According to the present invention, a portable heater includes an outer housing having a first or front face, a second or rear face, and two sides interconnecting the front and rear faces. An air inlet is located on the front face of the housing, preferably along a lower portion thereof. A gas supply or tank is partially enclosed and supported by the outer housing. The gas supply or tank is optionally connected with a swivel connector for ease in replacing the supply, and a stationary regulatory within the heater housing decreases the pressure of the supply. A burner venturi, having a cylindrical body extending upwardly at a slight angle, is disposed within the housing. The burner venturi also has a mouth operatively associated with a bottom end of the cylindrical body. Gas is released from the gas supply into the mouth of the burner venturi. At the same time, air is drawn into the mouth of the burner venturi from the air inlet. The air and gas mix thoroughly as they travel upwardly through the burner venturi.

Upon exiting the burner venturi, a baffle directs the air/gas mixture into a plenum to further mix, enter a rear face of a radiant surface, and then ignited on a top surface where combustion occurs. Any conventional means for initially sparking or igniting the air/gas mixture at the burner surface can be used. The burner plenum is heated to an elevated temperature and the radiant surface emits heat to the ambient environment. Combustion products are directed off a deflector shield which reduces the temperature of the products before exiting an outlet at an upper portion of the housing.

The air inlet of the present invention is advantageously designed to provide air flow along the hot burner plenum resulting in an increased velocity of air flow to the burner venturi. As the burner venturi is heated, the thermal properties result in the air/gas mixture passing upwardly through the angled burner venturi creating a chimney type effect. The chimney effect created by the present invention increases the air flow velocity into the burner venturi. In addition, the device reduces pressure from the gas supply and has the ability to satisfy combustion requirements at low fire condition.

This improved invention uses a single regulator in conjunction with two swivel connectors, preferably with check valves therein. These and other objects of the present invention will become more readily apparent from a reading of the following detailed description taken in conjunction with the accompanying drawings wherein like reference numerals indicate similar parts, and with further reference to the appended claims.

According to one aspect, the present invention provides a portable radiant heater supplied by an associated fuel source. The heater comprises a housing having a handle for transporting the heater and a plenum in the housing receives fuel from the associated fuel source and mixes the fuel with air. A burner assembly includes a radiant surface that communicates with the plenum. A regulator limits the pressure of the associated propane source to approximately eleven inches water column, and an oxygen depletion system associated with the burner assembly automatically shuts off the heater at a predetermined oxygen content. A tank fitting with a position that can be adjusted relative to the regulator facilitates the installation of the associated fuel source to the heater.

According to another aspect, the present invention provides a portable radiant heater including a regulator that is coupled to the heater at a fixed position relative to the housing. The tank fitting is optionally pivotally coupled to a bracket to pivot about a transverse axis relative to the bracket, which is itself coupled to the housing. The portable radiant heater can further include a fitting nut that is stationary relative to the housing to which a fuel-carrying conduit is coupled to establish fluid communication between the pivotal tank fitting and the regulator. The bracket can optionally be slidable along a track to be selectively withdrawn from, and introduced into the housing for exposing the tank fitting externally of the housing and facilitating installation of the associated fuel source. The fuel-carrying conduit can be a flexible fuel hose to allow the position of the slidable bracket to be adjusted during installation of the associated fuel source.

According to yet another aspect, the present invention provides a portable radiant heater comprising a plurality of tank fittings, each with a position that can be adjusted relative to the regulator to facilitate the installation of a plurality of associated fuel sources to the heater. At least one tank fitting can optionally be disposed adjacent to each lateral side of the heater and the regulator is separated approximately equidistantly from the at least one tank fitting adjacent to each lateral side. Optionally, the regulator is stationary relative to the housing and each tank fitting can be adjusted relative to the housing of the heater. Each tank fitting can also be pivotally coupled to the housing to pivot about a transverse axis relative to the housing to facilitate installation of the associated fuel source. For example, each tank fitting can be pivotally coupled to a door that can be adjusted to a closed position to conceal the associated fuel source to pivot about a transverse axis relative to the door.

According to yet another aspect, the present invention provides a portable radiant heater including a tank fitting that is releasably coupled to the heater by a releasable bracket. The releasable tank fitting can be removed from the releasable bracket while remaining coupled to a flexible fuel line that transports fuel from the associated fuel source to be delivered to the regulator.

BRIEF DESCRIPTION OF THE DRAWINGS

The invention may take physical form in certain parts and arrangement of parts, embodiments of which will be described in detail in this specification and illustrated in the accompanying drawings which form a part hereof, and wherein.

DETAILED DESCRIPTION OF ILLUSTRATIVE EMBODIMENTS

Figure 1:
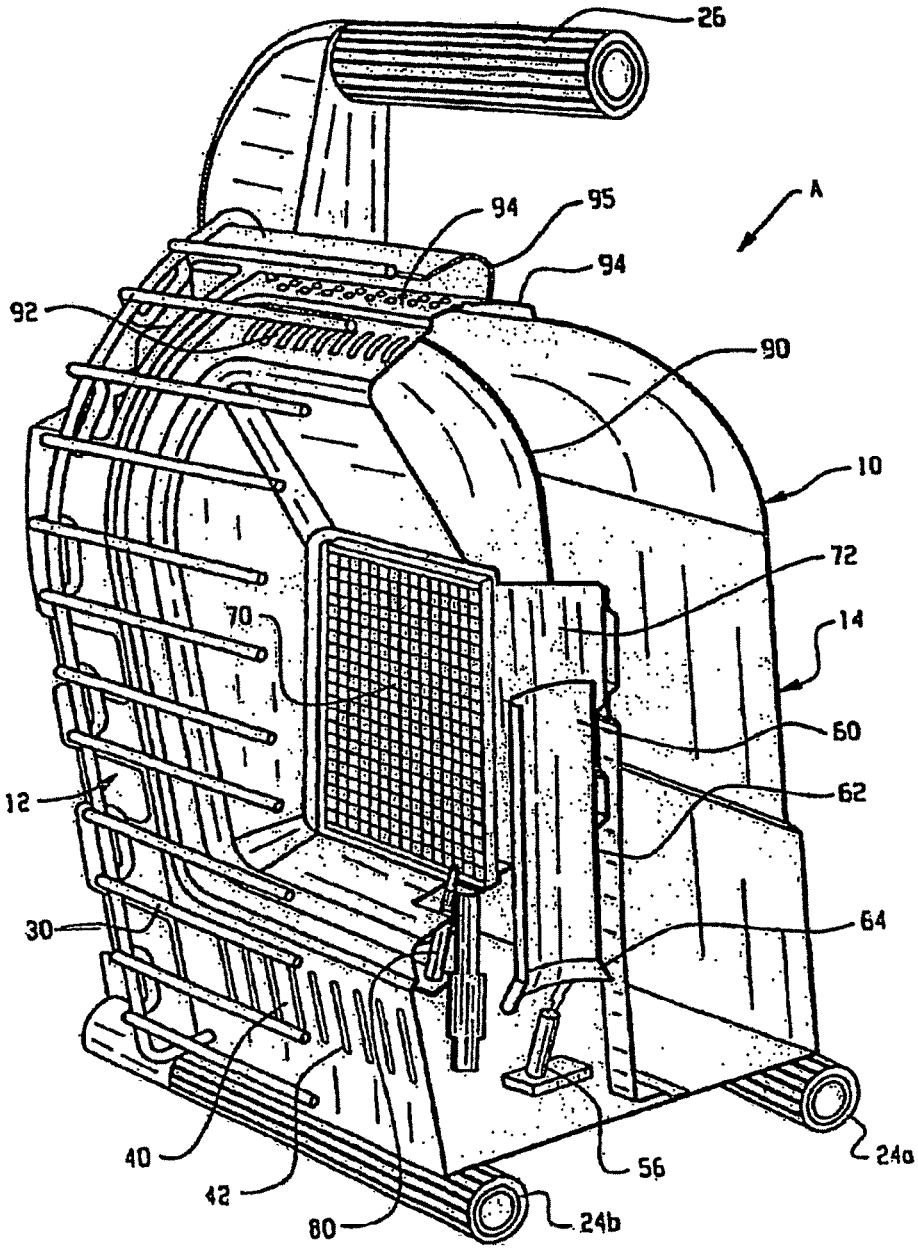
FIG. 1 is a perspective cross-sectional view of a heater assembly in accordance with an embodiment of the present invention.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

The Figures show a portable heater for use in confined spaces with various configurations for the positioning of the fuel source(s). Referring now to the drawings wherein the showings are for purposes of illustrating the preferred embodiment of the invention only, and not for purposes of limiting same, the Figures show a portable heating device A adapted for use in small enclosed environments. Although the present invention is designed for use in recreational enclosures and temporary work enclosures, it will be appreciated that other uses are contemplated.

The portable heater A includes a housing 10 having a front face 12, a rear face 14, and two sides 16, 18. The housing 10 is preferably manufactured to have smooth contours to prevent snagging or catching of things such as clothing, fabric, etc. A stepped recess or external cavity is formed in an upper front corner region of the left side 16 of the housing 10 for supporting a control knob or temperature controller 20. The recess provides protection against inadvertent contact and accidental changing of the temperature. The temperature controller 20 preferably has four positions: off, pilot, low, and high (not shown) although continuously variable positions for infinitely variable heating is also contemplated within the scope of this invention. Controller may incorporate a piezo spark igniter integral to controller stem rotation.

Another recess is disposed on the upper back corner of the left side 16 of the housing 10. This recess supports an igniter button 22 for activating the heater A. This recess also protects against inadvertent contact with the igniter button 22.

The heater A is supported by two elongated legs 24*a*, 24*b* laterally disposed along the outboard edges of the rear face 14 and front face 12 respectively. The legs 24*a*, 24*b* are preferably grooved providing a friction surface to contact the supporting surface and preferably extend over the entire width of the housing to provide a wide "footprint" and stable support area for the heater. In another embodiment (not shown), additional legs extending front to rear are provided beneath legs 24*a*, 24*b* to increase air flow beneath the heater. Further embodiments foresee alternative leg arrangements, such as a vertically extending leg on each of the four corners of the base of the heater, or a leg extending front to rear on either side of the base of the heater. A handle 26 is recessed from and extends from the top of the heater at an angle directed away (approximately 15°) from the front face 12. The offset allows the handle to remain cool for handling by a user while the angled orientation of the handle 26 protects the user's hand from heat exiting the top of the heater while the user transports the heater. The handle 26 is optionally grooved providing an enhanced gripping surface for the user.

A shield or metal grid 30, is attached to the front face 12 of the heater to provide protection to the heater components. In addition, the shield prevents accidental contact with the hot portions of the heater front face 12. The shield is preferably made from elongated wire metal strips and peripheral pieces are received in openings 32 in the housing to secure the shield to the heater. In addition, only one screw (not shown) need be removed for access to the interior components enabling easy servicing or replacement of selected components of the heater. Two keyhole openings or recesses 34*a*, 34*b* are located on the upper portion of the back face 14 of the heater allowing the user to hang the heater in an elevated position.

An opening or air inlet 40 is disposed on a lower portion of the front face 12 of the heater for receiving and filtering air drawn into the housing. The air inlet 40 is preferably formed from a series of elongated slits 42 equispaced across the housing beneath the shield. However, any opening that adequately provides air inflow is within the scope of the present invention.

Figure 5:
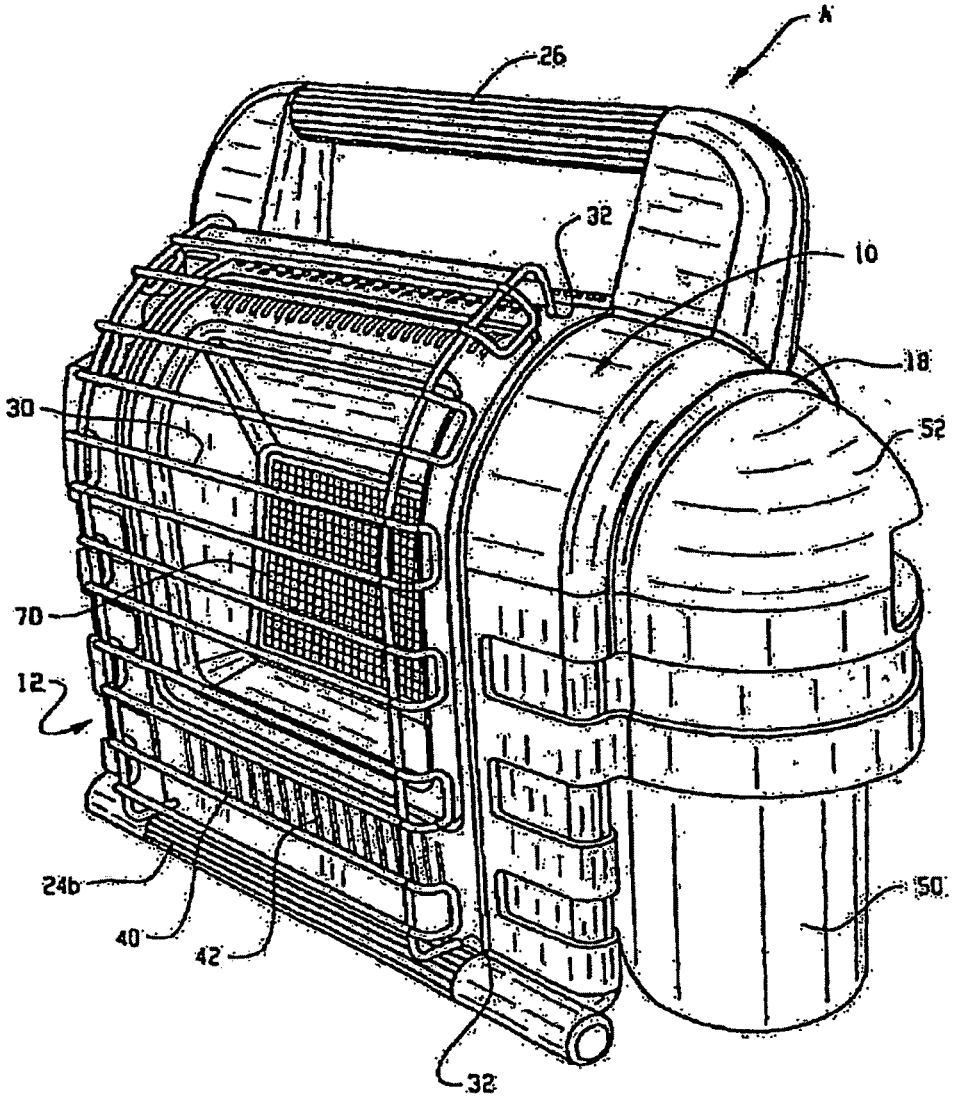
FIG. 5 is a perspective view of the heater taken generally from the front and right hand side.
Figure 6:
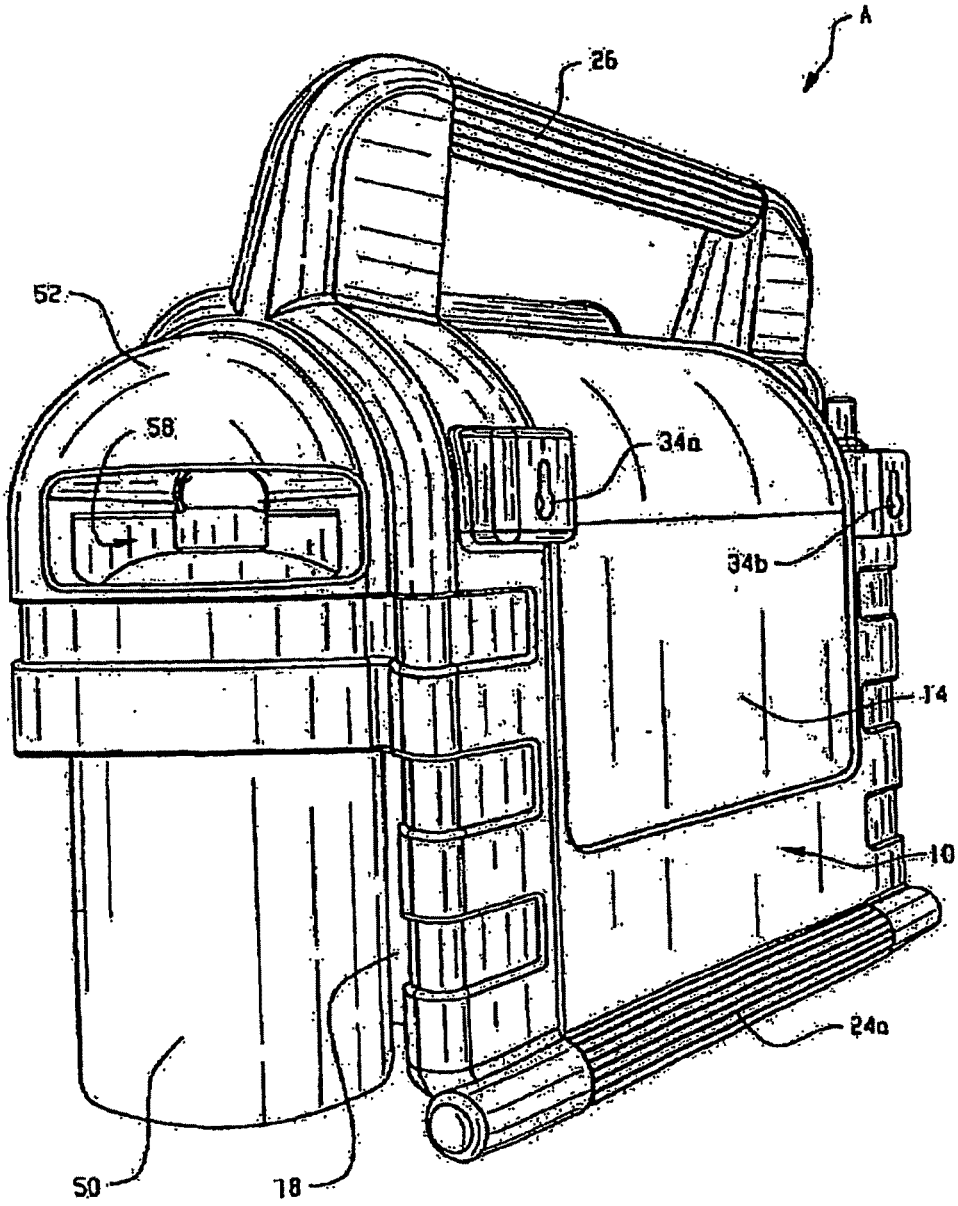
FIG. 6 is a perspective view of the heater taken generally from the rear and right hand side.
Figure 7:
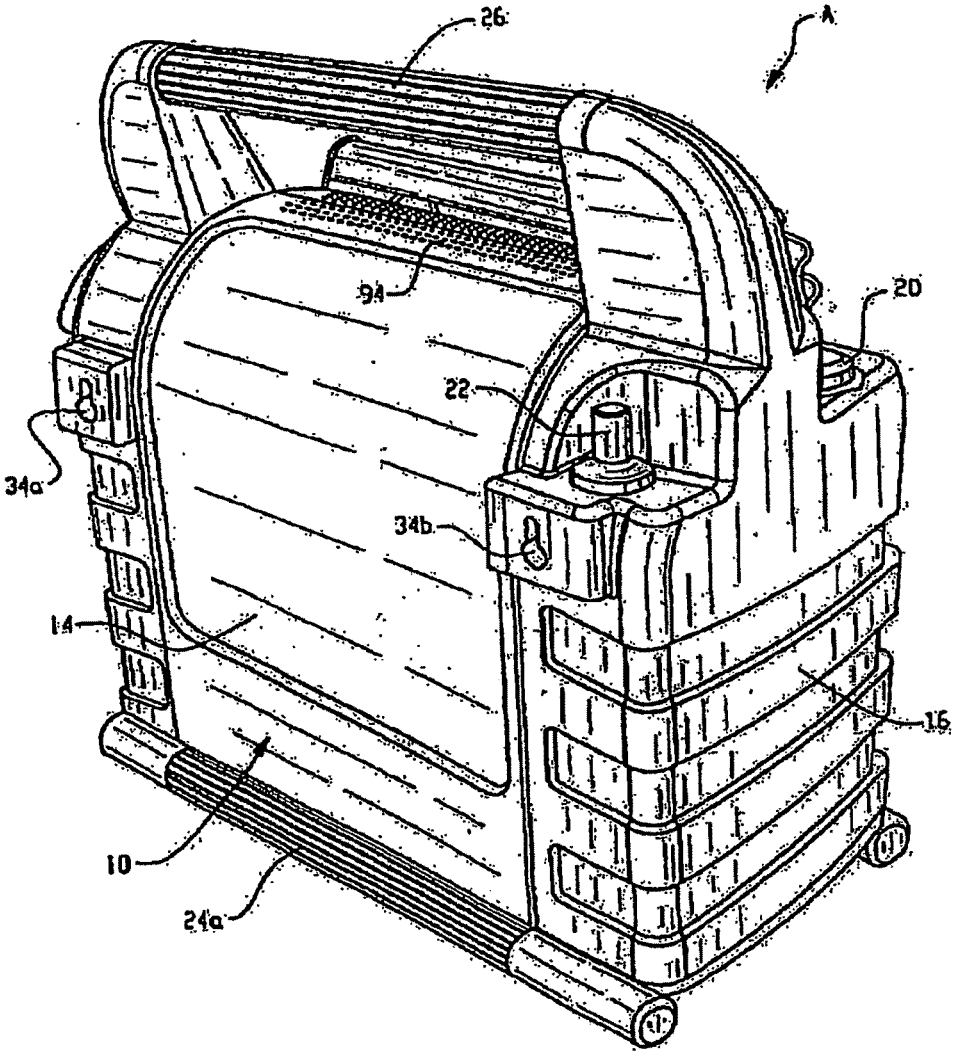
FIG. 7 is a perspective view of the heater taken generally from the rear and left hand side.
Figure 8:
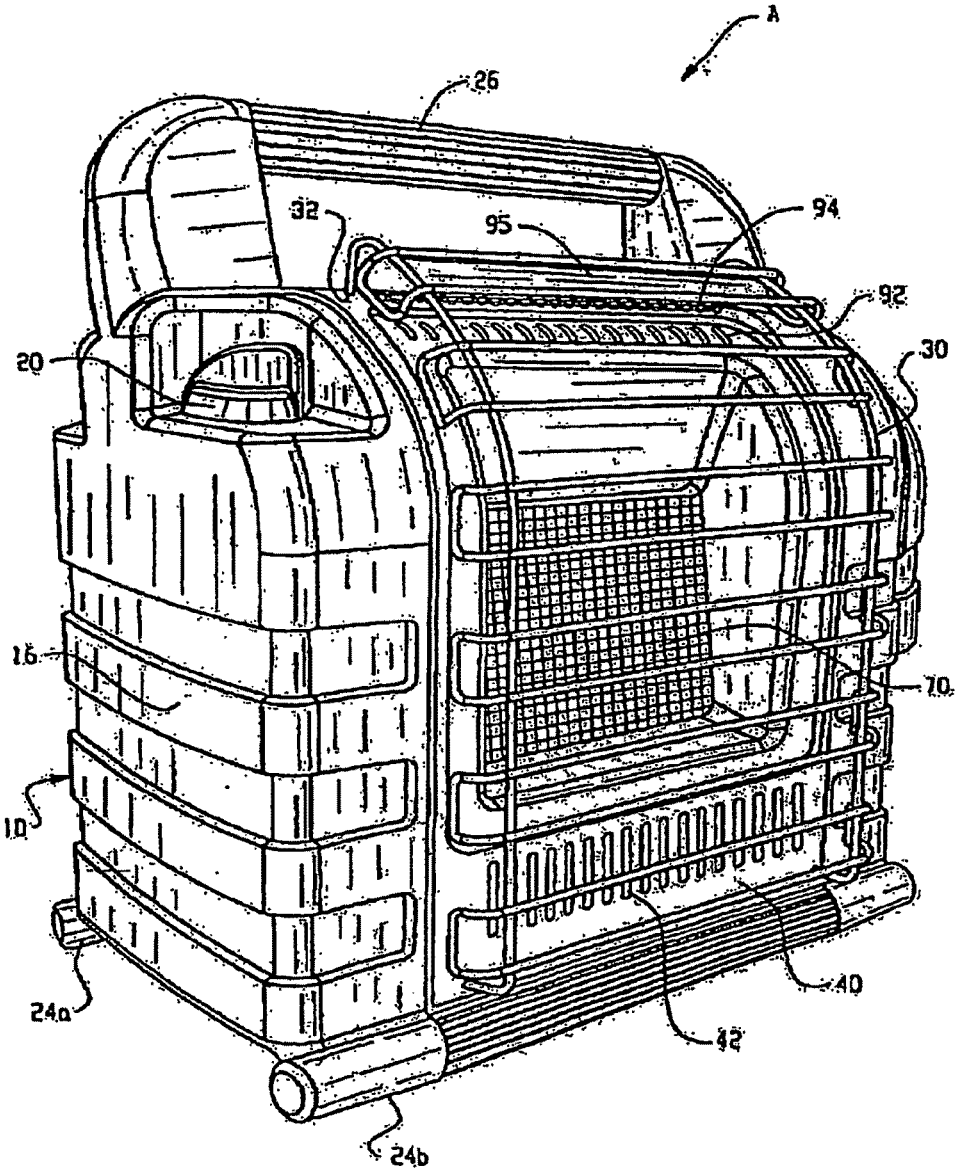
FIG. 8 is a perspective elevational view of the heater in accordance with an embodiment of the present invention.
Figure 9:
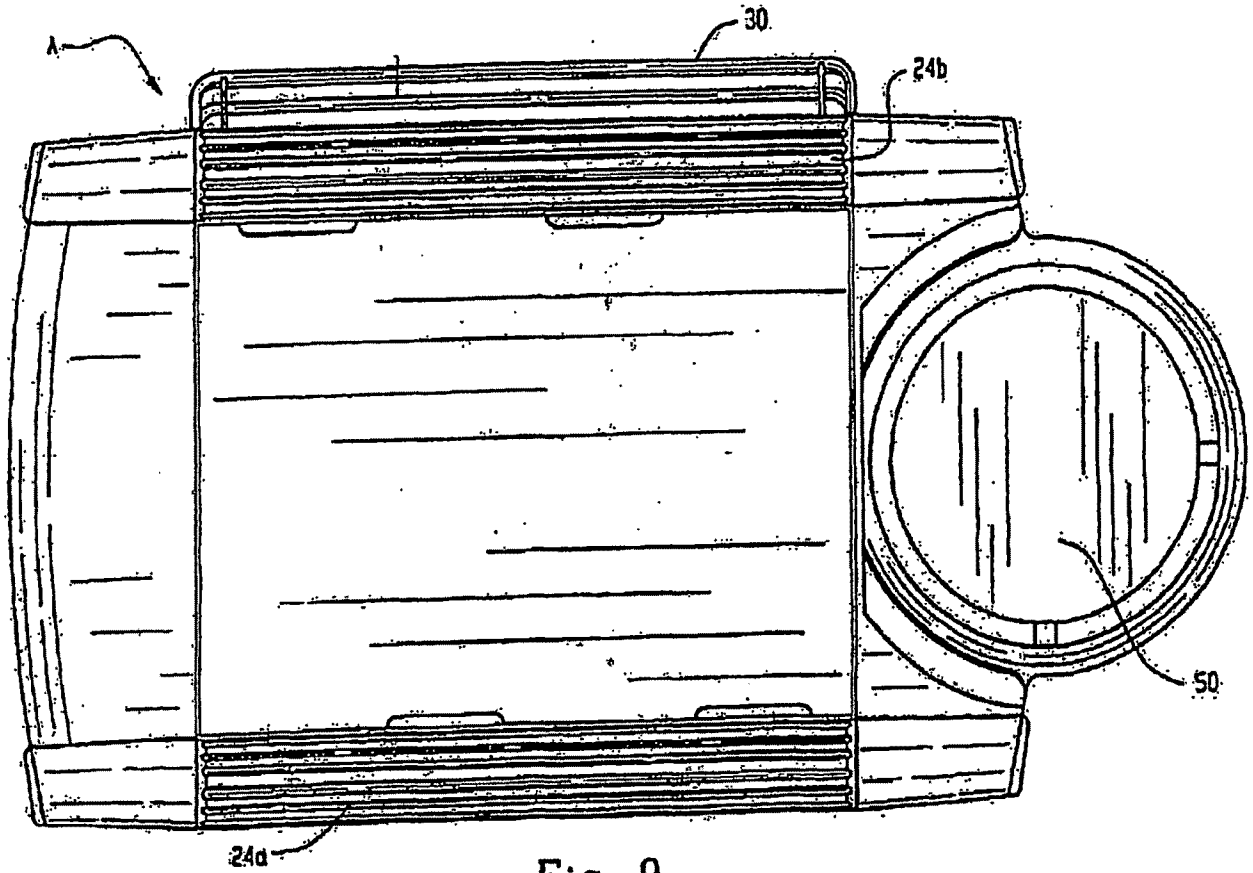
FIG. 9 is a bottom view of a portable heater in accordance with an embodiment of the present invention.
Figure 10:
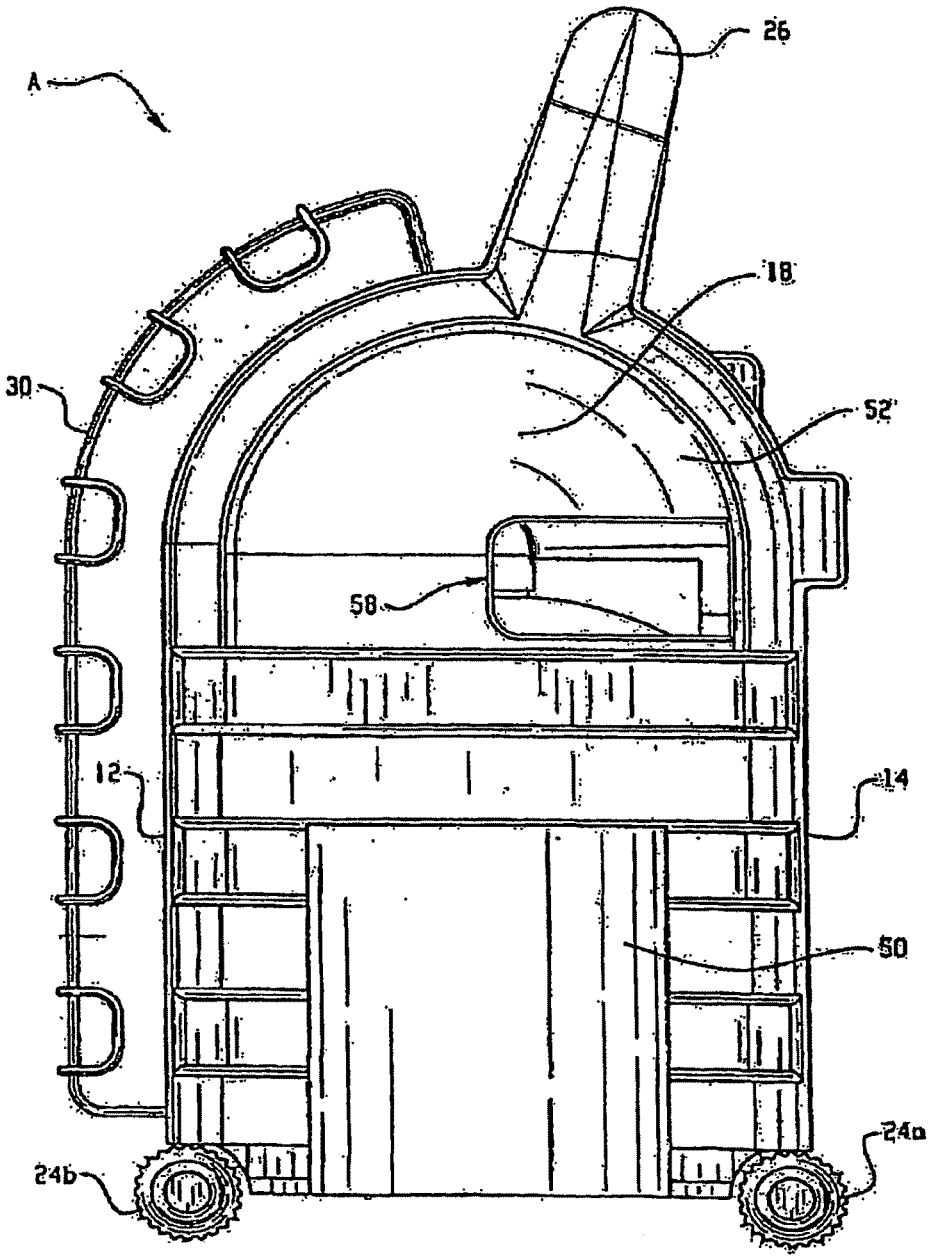
FIG. 10 is a side elevational view of a portable heater in accordance with an embodiment of the present invention.
Figure 11:
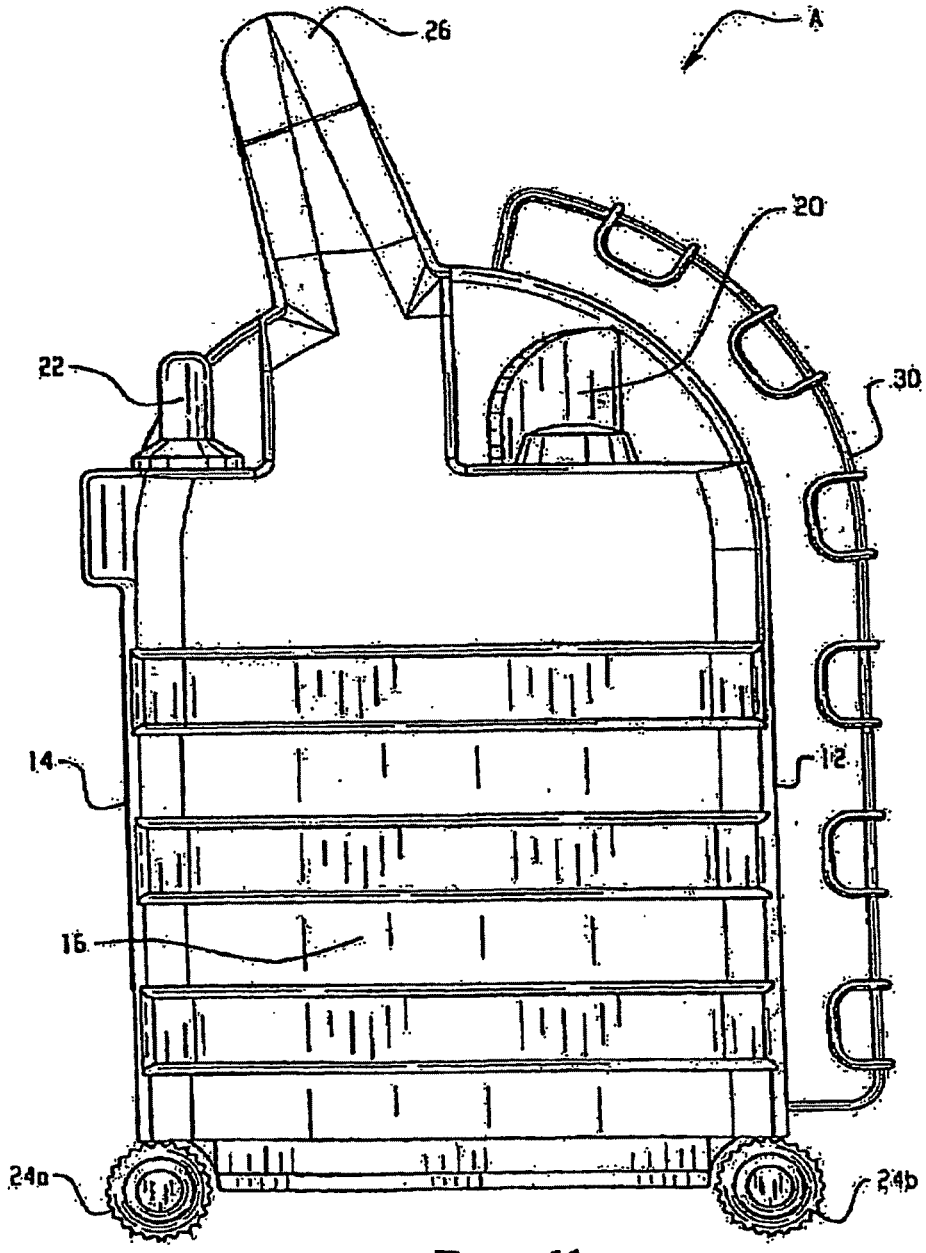
FIG. 11 is a side elevational view of a portable heater in accordance with an embodiment of the present invention.
Figure 12:
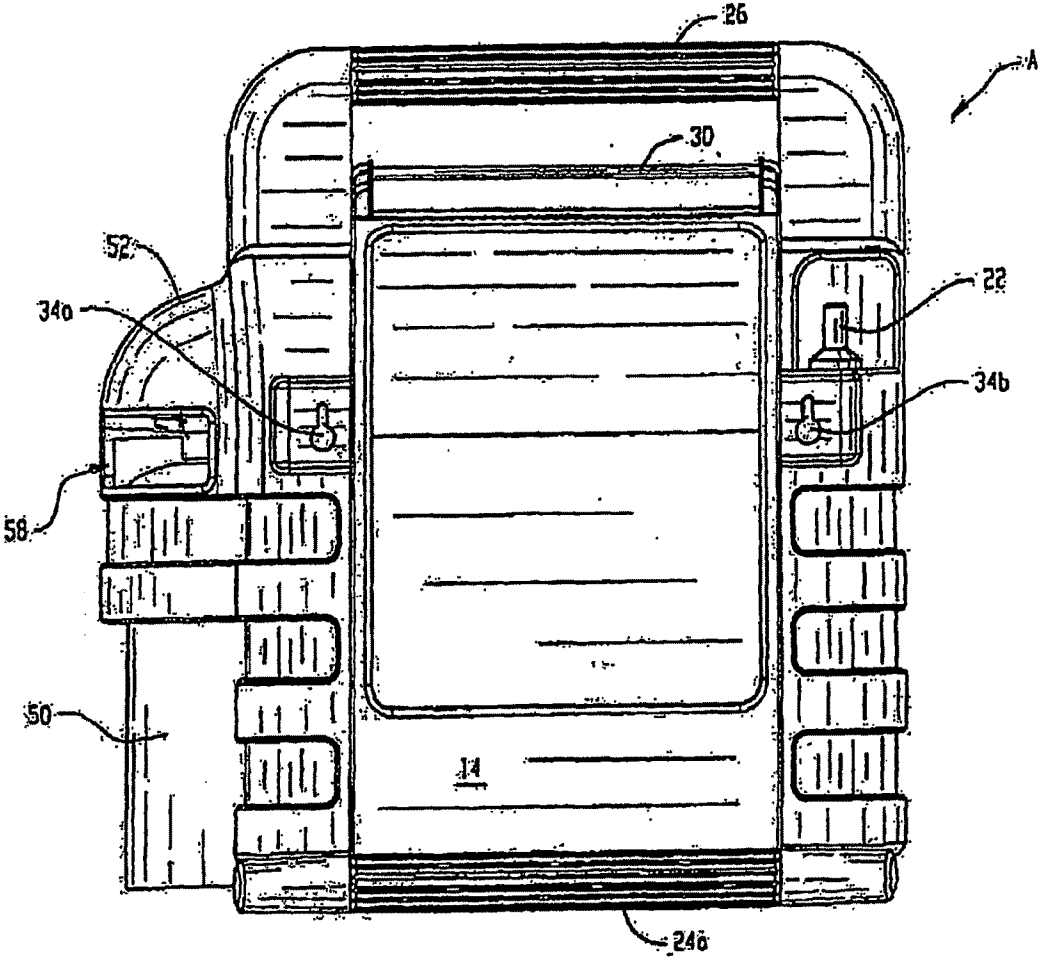
FIG. 12 is a rear elevational view of a portable heater in accordance with an embodiment of the present invention.
Figure 13:
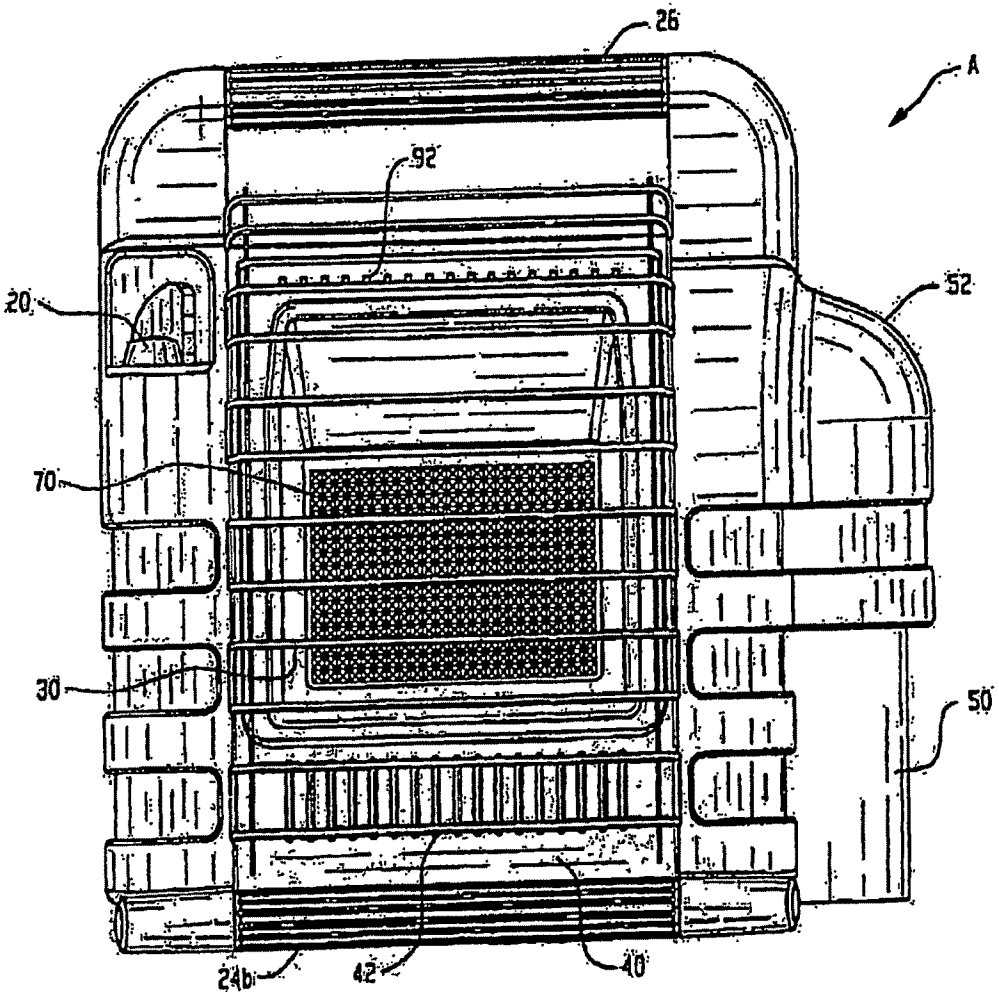
FIG. 13 is a front elevational view of a portable heater in accordance with an embodiment of the present invention.
Figure 14:
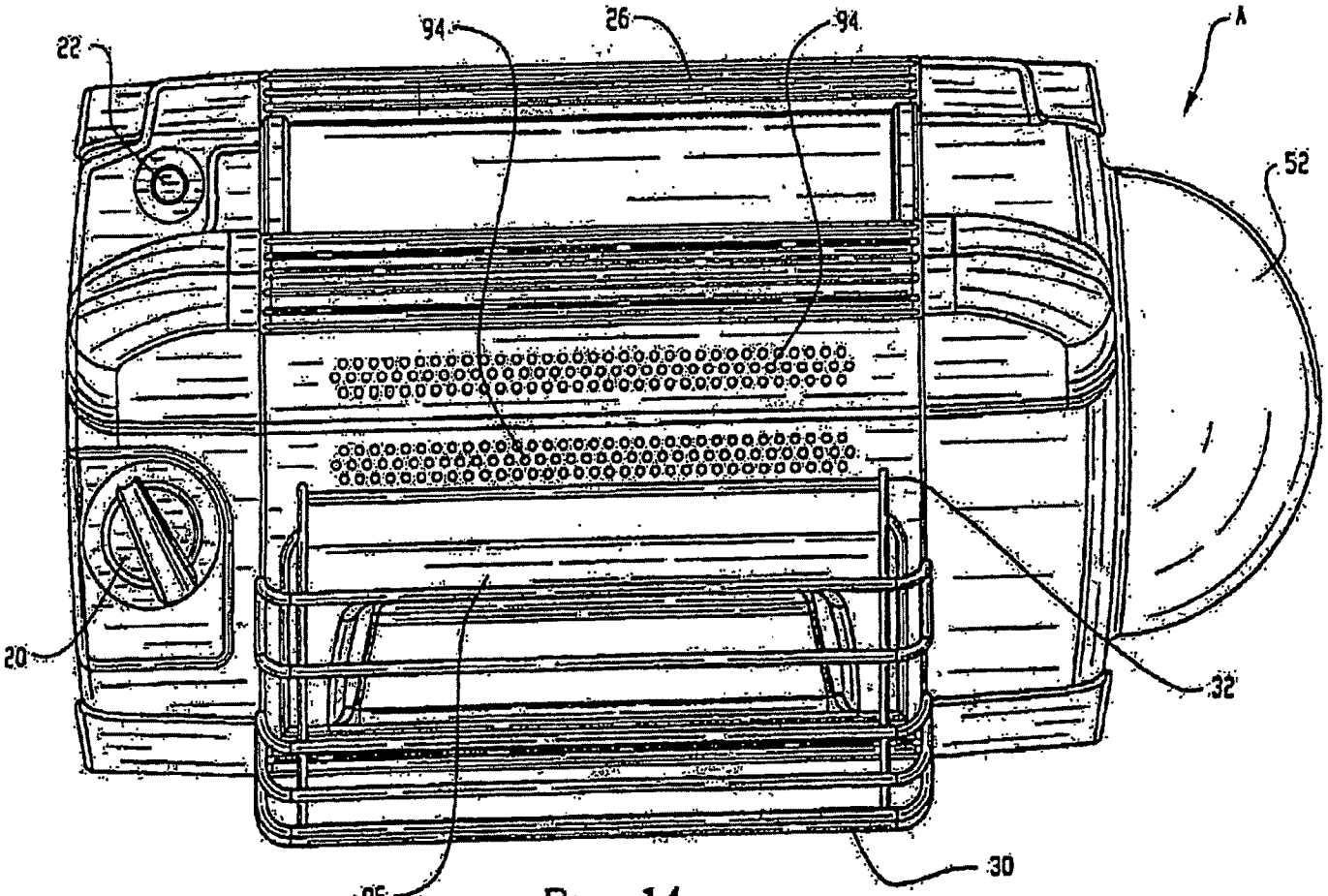
FIG. 14 is a top view of a portable heater in accordance with an embodiment of the present invention.

An LP ("Liquified Petroleum" or "Liquified Propane") gas supply tank 50 is secured to and partially enclosed by the housing 10 (See FIGS. 5 and 6). The LP gas supply 50 is preferably a removable canister or propane tank that can be replaced by a new tank or removed, refilled, and re-installed in the housing. A conical dome 52 protrudes from the side 18 of the housing 10 and partially encloses the gas supply tank 50. The dome acts as a protective shroud to cover the interconnection of the tank with the housing. For example, a one pound propane cylinder may be connected to the housing to provide approximately six hours of continuous operation on the low setting. Alternatively, the heater can be supplied, for example, by a conventional twenty pound propane tank having an extended length hose assembly so that the tank can be located away from the heated region. For instance, the propane tank can be positioned outside a tent, cabin, fishing shanty garage, etc. while the heater is located within the structure and the heater provide on the order of one hundred and ten hours of heat with the larger gas supply tank.

The gas supply 50 is connected through fittings and lines to a regulator which connects to a valve and orifice 56 (See FIG. 1) which is selectively adjustable between open and closed positions, access being provided to the gas supply fitting through window opening 58 for remote LP gas supply hose tightening and leak checking (see FIG. 6). Optionally the LP gas supply hose 130 with connector fittings 132, 134 is stored underneath the unit within receptacles 136 in combination with side ledges 138 illustrated in FIG. 27. It is recognized that the LP couplings may be "quick connects" when the supply pressure is already regulated to about 11" water column. In this embodiment, the quick-coupler hose is integral to the heater and downstream from heater regulator(s) but before the control valve to facilitate connection to a regulated hose supply from an external fuel source such as a 20 pound cylinder. Similarly, the regulated fuel supply (11" water column) could originate from a self-contained system as in a recreational vehicle. The quick-coupler hose connection would incorporate positive fuel shut-off in both male and female connection components to prevent fuel escape when disconnected.

Figure 2:
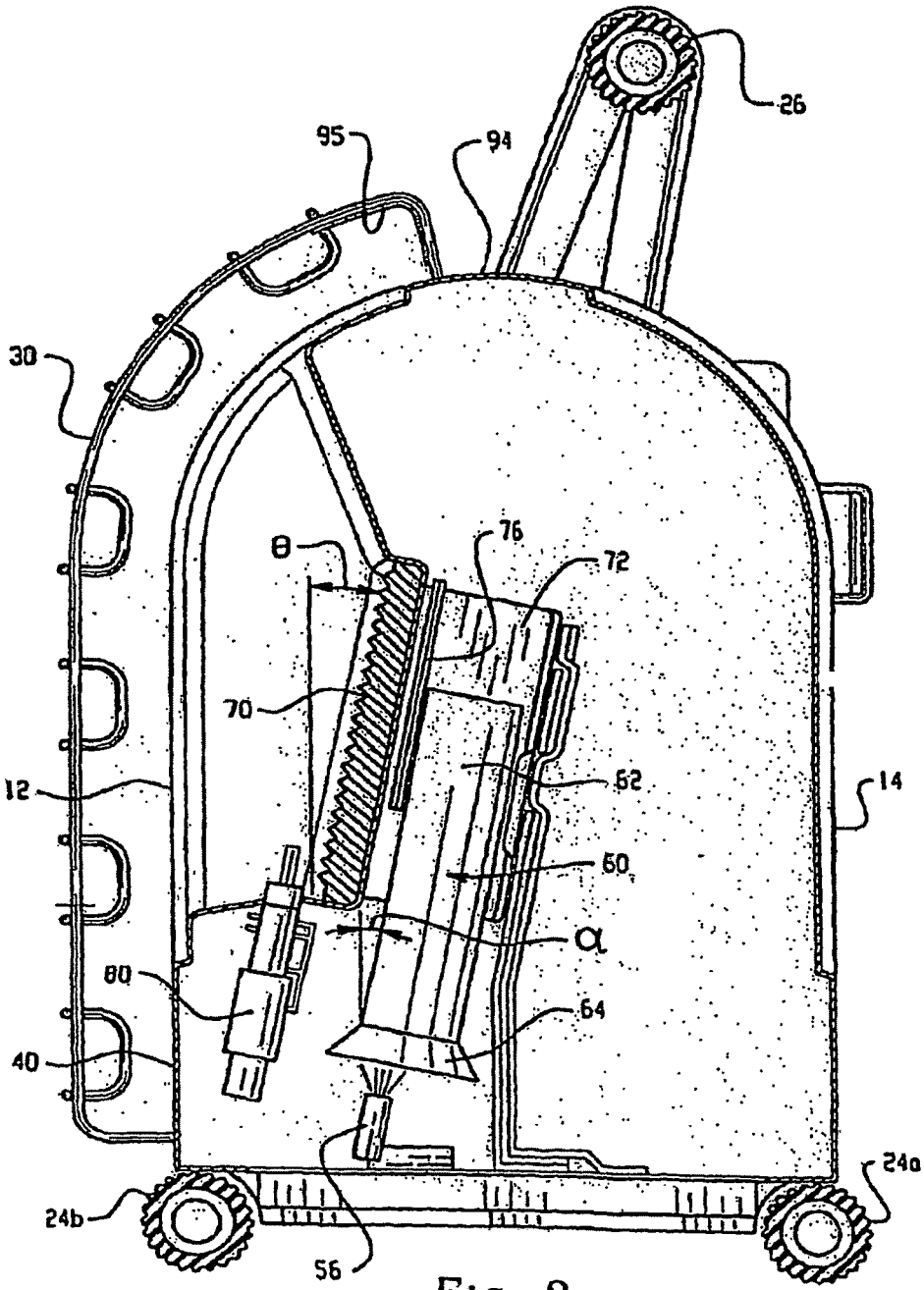
FIG. 2 is a longitudinal cross-sectional view of the heater assembly in accordance with an embodiment of the present invention.

Referring again to FIGS. 1 and 2, a burner venturi 60 is enclosed within the housing 10 and operates to mix oxygen and propane for combustion. The burner venturi 60 has a hollow generally cylindrical body 62 and a tapered mouth 64 having a wider diameter than the body 62. The burner venturi is disposed at an angle a relative to the longitudinal axis of the heater A. The mouth 64 of the burner venturi is positioned on approximately the same axial plane as the air inlet 40 and the cylindrical body 62 extends upwardly from the mouth 64. The orifice 56 which is attached to the gas supply 50 is located directly beneath the mouth 64 of the burner venturi 60.

Also located within the housing 10 is a generally planar radiant surface 70 disposed at an angle a relative to the longitudinal axis of the heater. A rear face of the radiant surface is in communication with a cavity or plenum chamber 72. The burner plenum receives the air/gas mixture from the venturi and distributes the mixture over and through the rear face of the radiant surface. Thus, in operation, the orifice 56, attached to the gas supply, is opened releasing a fuel gas such as propane into the mouth 64 of the burner venturi 60. Associated with the orifice is a regulator that reduces the delivery pressure of the fuel gas from the tank (rated up to 150 psi) to eleven inches of water column in one stage. Thus, this portable heater operates at a significantly lower pressure than existing commercially available units. The stream of gas exiting the orifice 56 creates a vacuum effect drawing air from the air inlet 40 into the mouth 64 of the burner venturi. Propane and air are thoroughly mixed in the burner venturi 60 and plenum 72 in order to achieve complete combustion and produce a clean burning infrared heating surface. The mixture of oxygen and propane travels upward through the cylindrical body 62 of the burner venturi 60 until reaching the plenum chamber 72. To prevent the mixture of propane and oxygen from immediately exiting the plenum chamber 72, a solid baffle 76 is provided which forces the air/gas mixture downward into communication with the rear face of the radiant surface.

The radiant surface may be a burner tile or a multi-ply screens (not shown) that define a plurality of small openings which permit combustion of the air/gas mixture as it passes therethrough. A means is provided for initially sparking or igniting the mixture at the radiant surface. In the present invention a container 80 houses the pilot 82 and the igniter 84 (see FIG. 3) which provides the initial sparking. It will be appreciated that any conventional means for initially sparking or igniting the mixture can be utilized. Combustion of the air/gas mixture is maintained and reaches elevated temperatures of approximately 1200° F. The heater shown in the drawings with one propane cylinder is rated at a minimum 4000 BTUs and a maximum 9000 BTUs at eleven inches water column pressure. Other ratings are also potential alternatives, including up to 20,000 to 25,000 BTU models when more than one propane cylinder and associated burner assemblies are utilized.

A reflector 90 extends outwardly from the top of the burner plenum 72 at an angle directed toward the top portion of the front face 12 of the housing 10. The natural convective upward path of the combustion products leads the combustion products into contact with the reflector 90. The reflector 90, in addition to directing the radiant energy output from the heater toward the front surface of the housing, also acts as a deflector and reduces the temperature of the combustion products exiting the heater which greatly reduces the chance for ignition of a combustible material if it comes into contact with the heater A. An outlet 92 is disposed near the top of the housing 10 allowing warm air to mix with combustion products and exit the device after contacting the reflector 90. In addition, a deflector 95 is disposed on the top of front face 12 which reduces the temperature of the combustion products exiting the heater which greatly reduces the chance for ignition of a combustible material if it comes into contact with the heater A.

In addition, there is an outlet or grate 94 disposed rearward of outlet 92 that communicates with the interior of the housing. It provides a continuous flow Path for air (that does not enter the venturi) to flow from the inlet 40 around the rear of the plenum chamber and exit the housing rearward of the deflector. This enhances the chimney effect as described above since a large amount of ambient air is drawn into the housing, a portion used for combustion purposes and the remainder convects upwardly along the rear of the plenum and the deflector to exit via the openings 94. The air inlet 40 of the present invention is designed to encourage air flow along the back of the hot burner plenum 72, advantageously resulting in an increased velocity of air flow to the burner venturi, as well as cooling the rear housing 10. As the burner venturi 60 is heated, the thermal convection properties urge the air/gas mixture through the upwardly angled burner venturi 60 creating a chimney type effect. The chimney effect created by the present invention increases the fresh air flow velocity into the burner venturi, enabling the pressure from the gas supply 50 to be reduced, yet burn efficiently on high or low settings.

Figure 3:
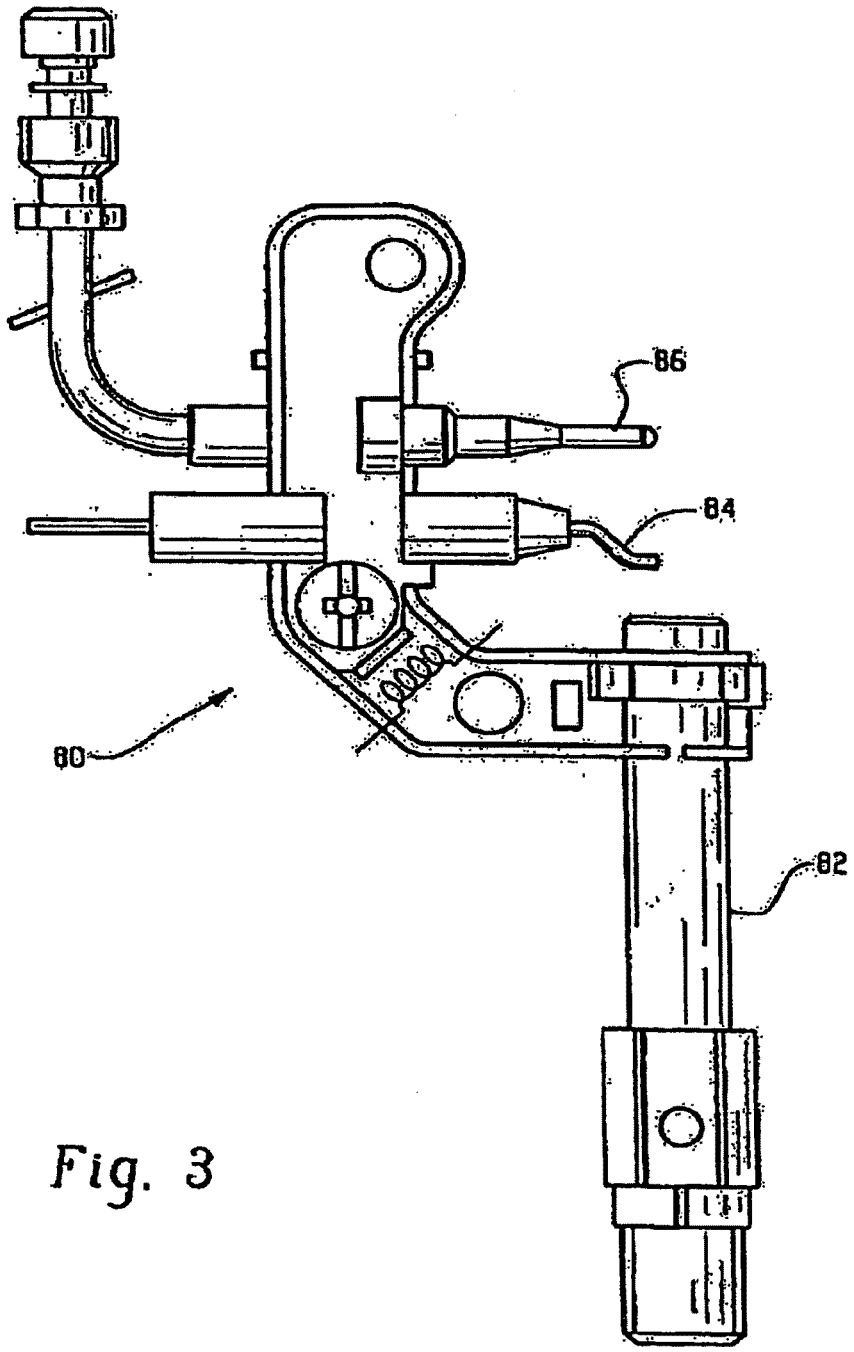
FIG. 3 is an enlarged elevational view of a thermocouple, spark igniter, and pilot tube assembly used in an embodiment of the present invention.

In addition to housing the pilot 82 and the igniter 84, the container 80 preferably houses an oxygen depletion system (See FIG. 3). The oxygen depletion system (ODS) provides an automatic shutoff mechanism when decreased oxygen levels and resulting increased carbon monoxide concentrations are detected. For example, the heater of the present design is intended to automatically shut off at 100 PPM of carbon monoxide at 18% oxygen levels (21% free normal air). A thermocouple 86 monitors changes in temperature of the pilot flame which indicates changes in oxygen and carbon monoxide levels. Previous designs found in the prior art use a thermocouple/plunger type safety shut-off arrangement, which is not deemed to be as sophisticated or precise as the ODS of the present invention. The addition of an ODS to portable unvented heaters is an improvement in the art and the first of its kind. A more detailed discussion of the ODS can be found in a variety of resources.

The present invention significantly reduces the pressure from the propane tank in one stage. The pilot burner must operate at 11" water column (W.C.) while the main burner may optionally operate at this same pressure although higher pressures are envisioned. This is the first portable device for indoor use that the applicant is aware of that conforms to this standard. The portable heaters that exist today all operate at high pressures (on the order of 12 psi) and do not incorporate an ODS. In addition, the present device has the ability to pass combustion requirements at a low fire condition.

Figure 15:
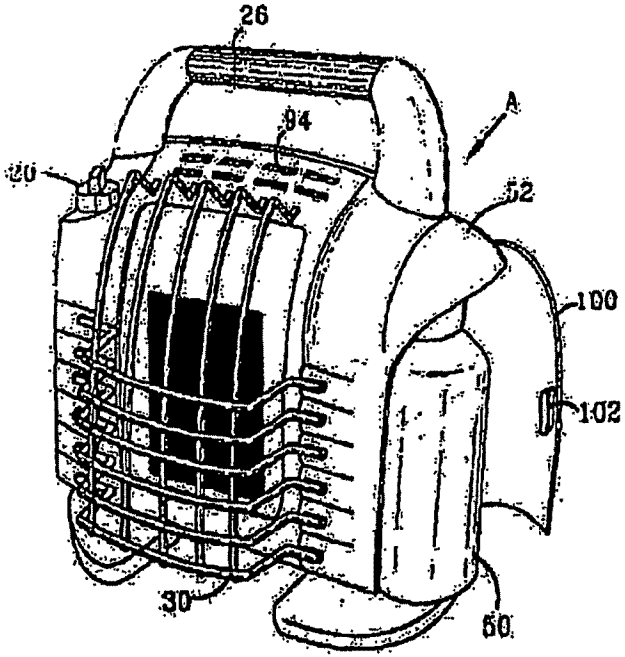
FIG. 15 is a side elevational view of a portable heater in accordance with an embodiment of the present invention showing a fully enclosed fuel source that can be exposed by opening of a hinged door.

In another embodiment of the invention illustrated in FIG. 15, the fuel source is positioned within housing 10 and is accessible through pivotable hinged door 100 with latch 102. Conical dome 52 extends partway down vertical side 18 and over at least a portion of the valve of fuel supply 50. Pivotal movement of hinged door 100 is accomplished by the user effecting vertical axial counterclockwise rotational movement about a pair of hinges or pivot axis (not shown) at one side of the door.

Figure 16:
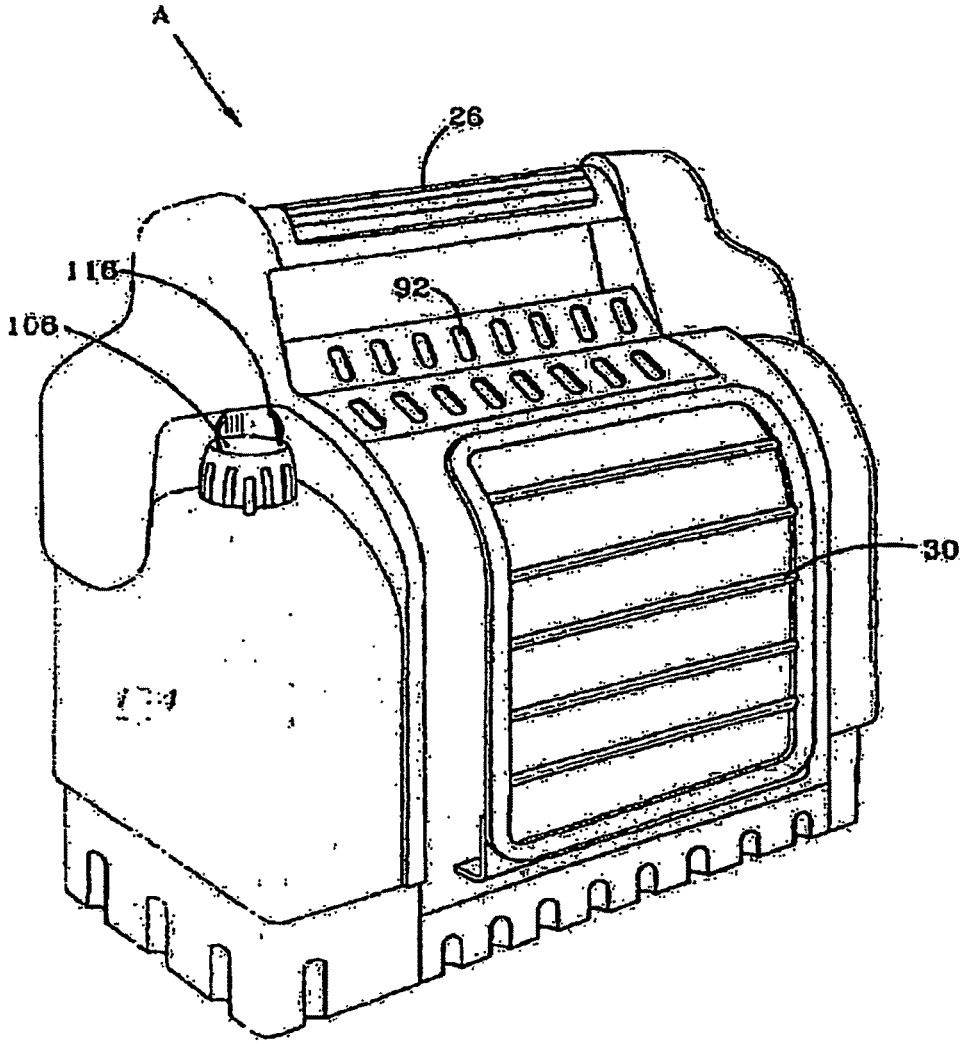
FIG. 16 is front elevational view of a portable heater in accordance with an embodiment of the present invention showing an attached battery pack for use with an optional fan to increase circulation.
Figure 17:
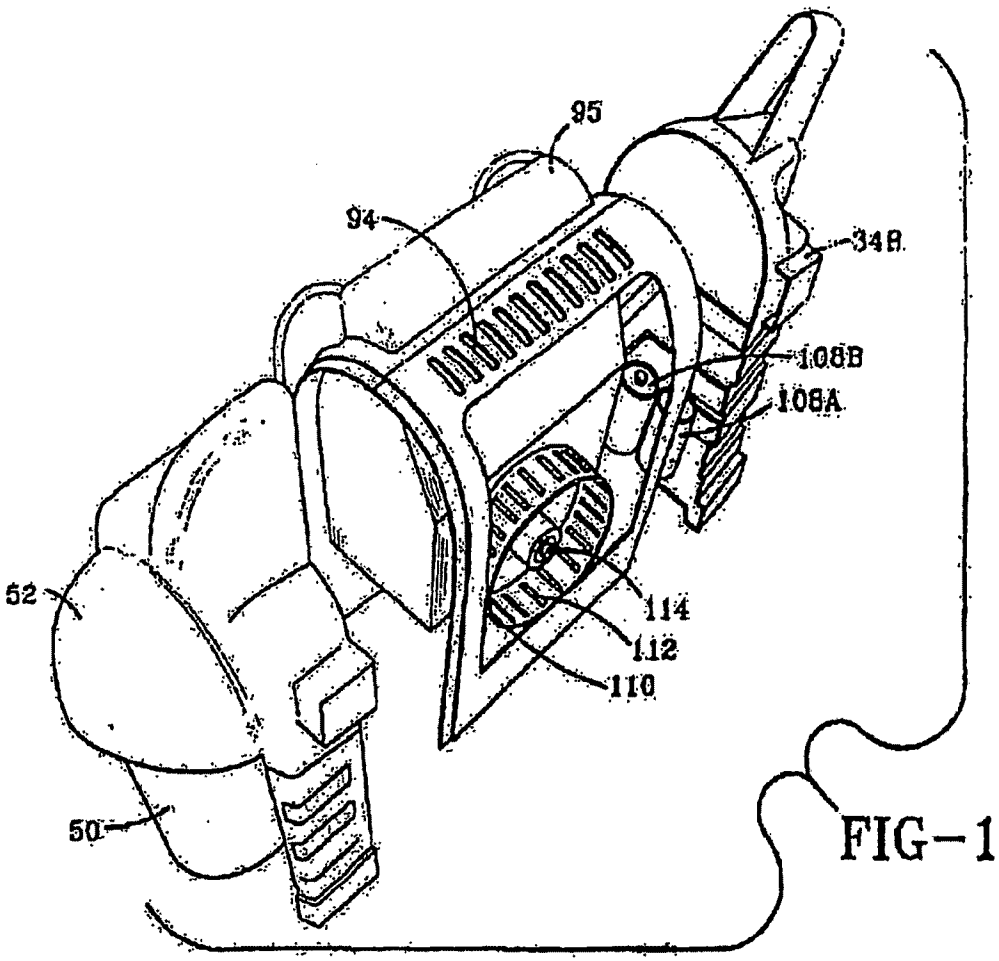
FIG. 17 is a top perspective view of a portable heater in accordance with an embodiment of the present invention with a top handle removed showing an optional rear fan in the housing operated by removable and optionally rechargeable dry cell batteries.
Figure 26:
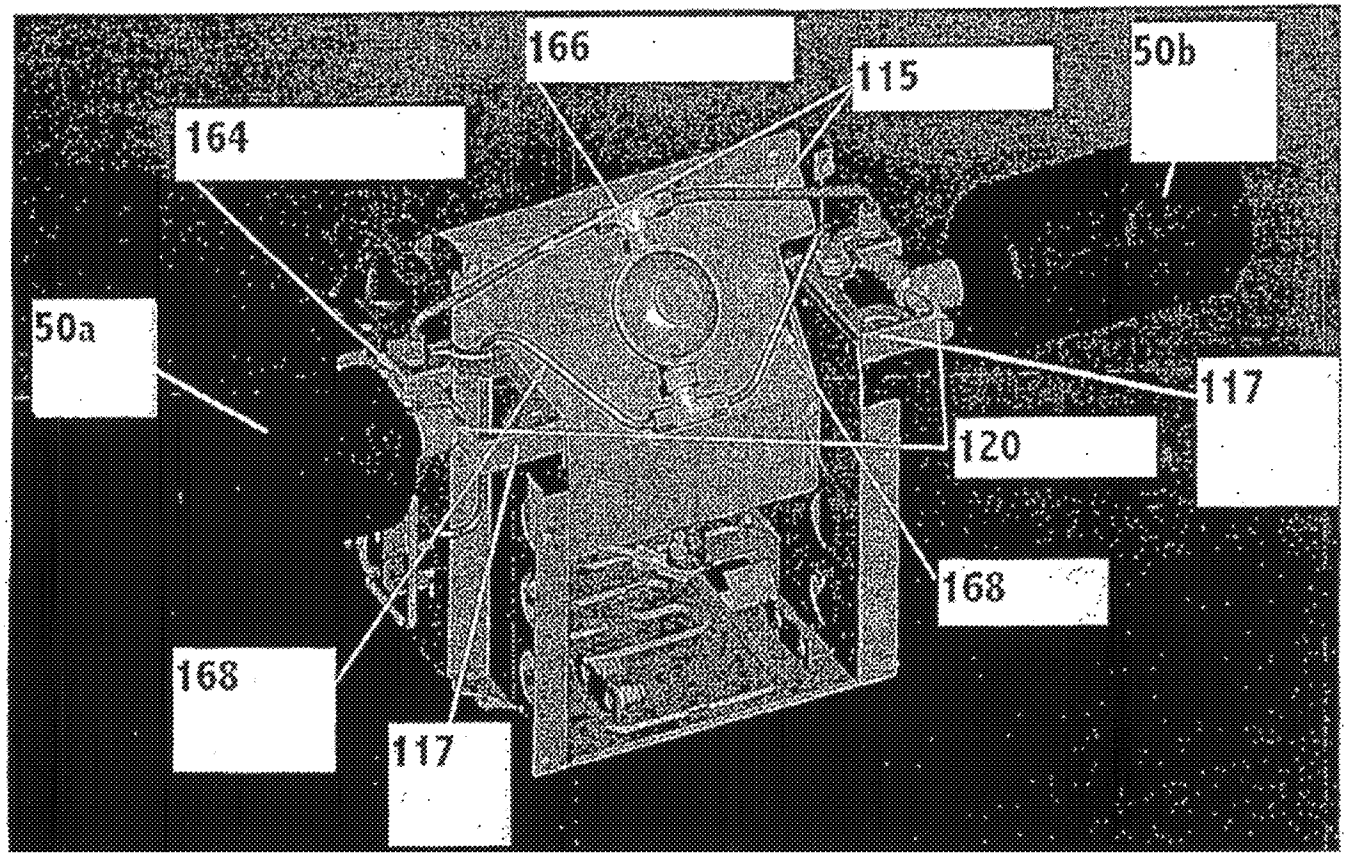
FIG. 26 is a rear perspective view of an embodiment of a heater according to the present invention with rear and side panels removed to illustrate pivotable fuel source rotation and inline regulator.

FIG. 17 illustrates yet another embodiment of the invention in which improved air flow is effected through heater unit A by the incorporation of a paddle or cage fan 110 in back panel 14. In one aspect shown in FIG. 16, a rechargeable battery pack 104 is illustrated to be positionable within accommodating slot 116 within side panel 16 of housing 10. Knob 106 is used to variably define the power setting used with battery pack 104 as well as to be used as an "on/off" switch for controlling the speed of fan 110. Alternatively, and in another aspect of the invention, at least one, preferably two or more rechargeable dry cell batteries, 108*a*, 108*b* are employed within side panel 16 of housing 10 as better illustrated in FIG. 17. The batteries are positioned to be loaded from the bottom of housing 10 and, the power controlled by a variably positioned knob 106 located toward the front of housing 10 or at an alternative position as is known in the art for controlling variable amounts of power to an electrical device. Depending on the rotational speed of the fan desired, coupled with battery life expectancy, anywhere from one to four "C" or "D" sized batteries are employed, although it is equally envisioned that "AA" batteries may be used in some models where power consumption is envisioned to be minimal or usage infrequent and for short duration. Fan 110 has a plurality of paddles or inwardly extending panels for creating air movement through rotational pivotal movement about axis 114. The fan is typically a lower voltage fan, e.g., 3.0 volts, powered by a direct current motor. This increased air flow insures maximal cooling capacity on various metal and plastic components in heater A. Battery operation is also illustrated in FIG. 26 where an alternative dry cell location is identified.

Figure 19:
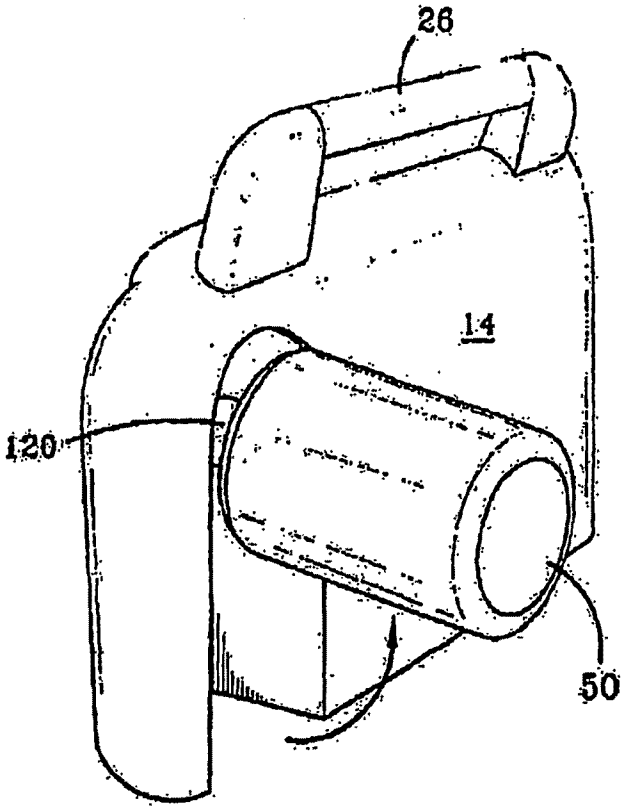
FIG. 19 is a rear elevational view of a portable heater in accordance with an embodiment of the present invention with the detachable door shown in FIG. 18 removed to illustrate a fuel source that is pivotable about a fuel supply connection.
Figure 18:
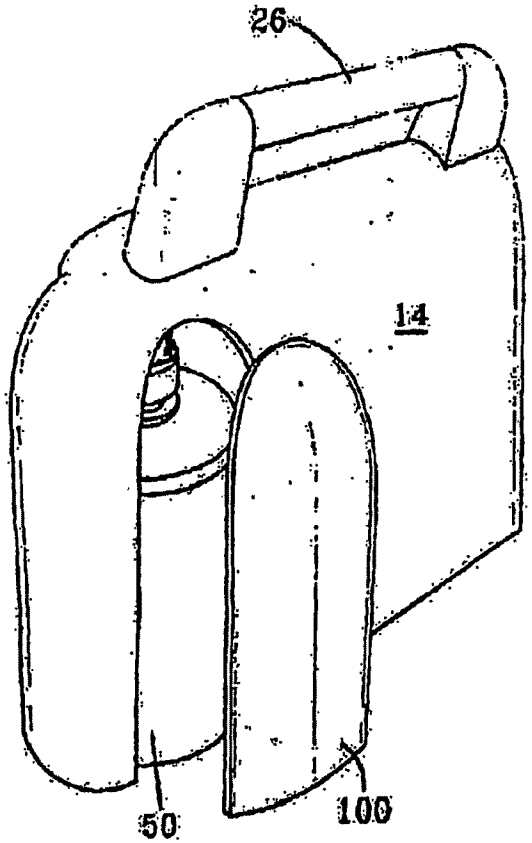
FIG. 18 is a rear elevational view of a portable heater in accordance with an embodiment of the present invention showing a detachable door for enclosing a fuel source.

FIGS. 18-19 illustrate another embodiment of the invention in which a snap-fit door 100 is removable from side panel 18 thereby permitting pivotal rotational movement from a first position to a second replaceable position of fuel source 50 by a swivel connection configuration. This configuration allows an end-user to rotate the fuel source for easier canister replacement without having to simultaneously lift the unit. This pivotal coupling is additionally illustrated in FIG. 27 where one fuel source 50 is shown rotated approximately 90°. Rotation of fuel source 50 may be in any direction facilitating ease of access to fuel source 50, including towards the rear of heater A, as shown in FIG. 19, or to the side of heater A, as shown in FIG. 26. Rotation in other directionalities is also possible, including any directionality allowed by the physical shape and size of heater A. The predetermined angle the fuel source is able to rotate is not limited, and can be any angle that facilitates ease of replacing the fuel source, but will commonly be approximately 90° from the heater, as shown in FIGS. 19 and 26, placing the fully rotated fuel source on a horizontal plane, allowing the user access and allowing full uninhibited sight of the fuel source connection to the heater.

Figure 28:
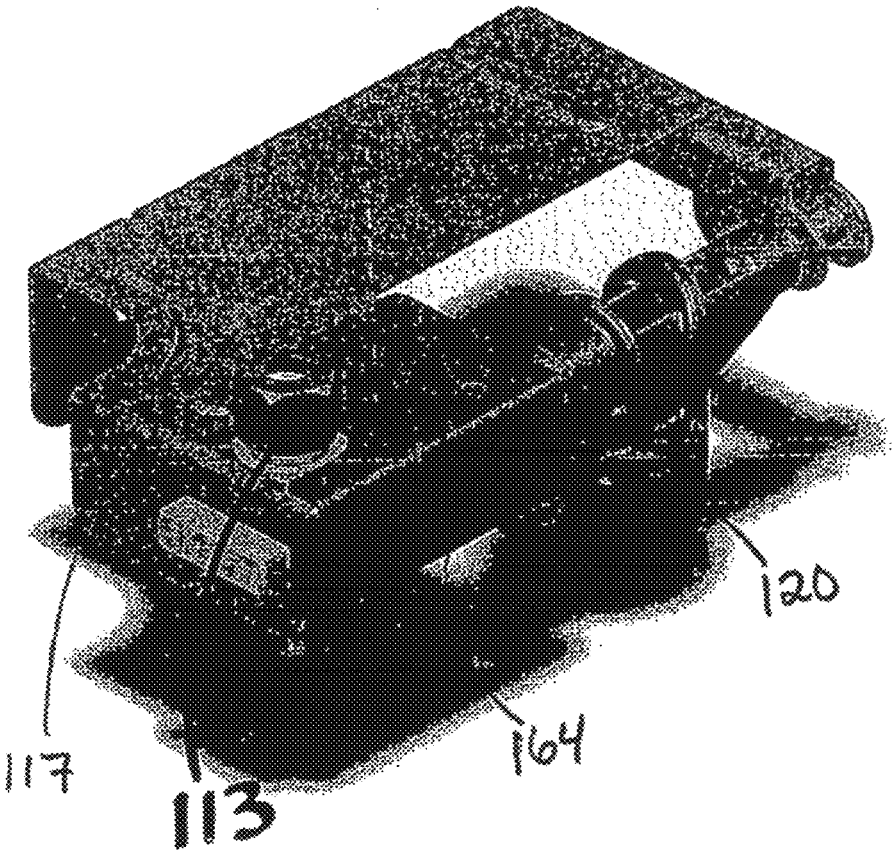
FIG. 28 is a side perspective view illustrating an embodiment of the rotatable connection and bracket for an LP gas supply.
Figure 29:
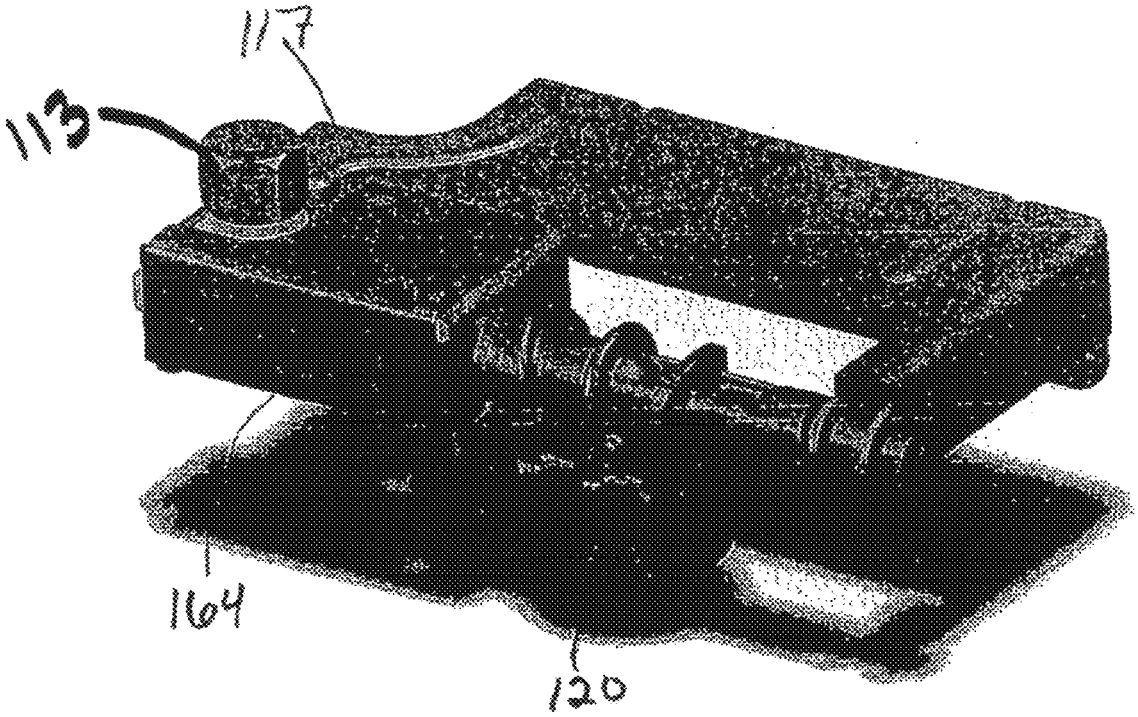
FIG. 29 is another side perspective view illustrating an embodiment of the rotatable connection and bracket of FIG. 28.
Figure 30:
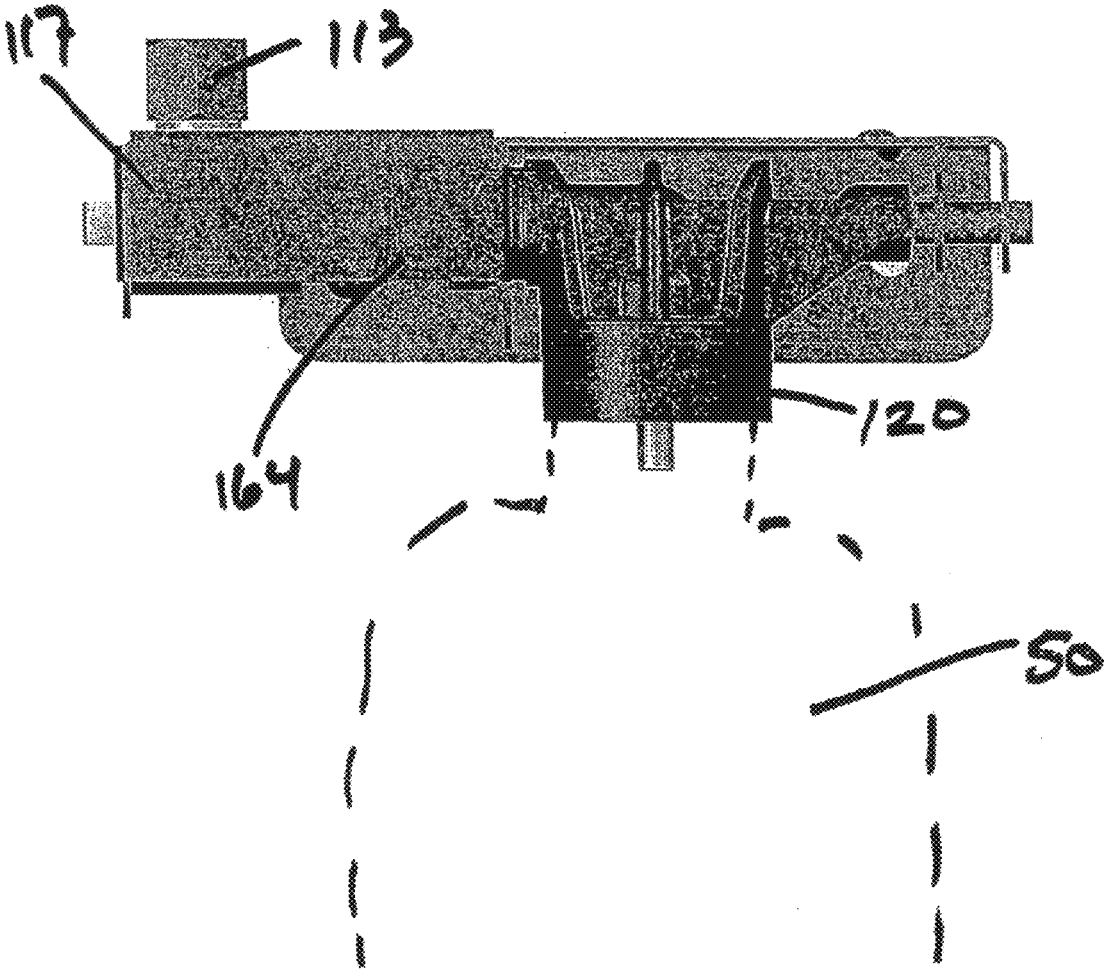
FIG. 30 is a front elevational view illustrating an embodiment of the rotatable connection and bracket of the LP gas supply, wherein said LP gas supply is shown in ghost lines.
Figure 31:
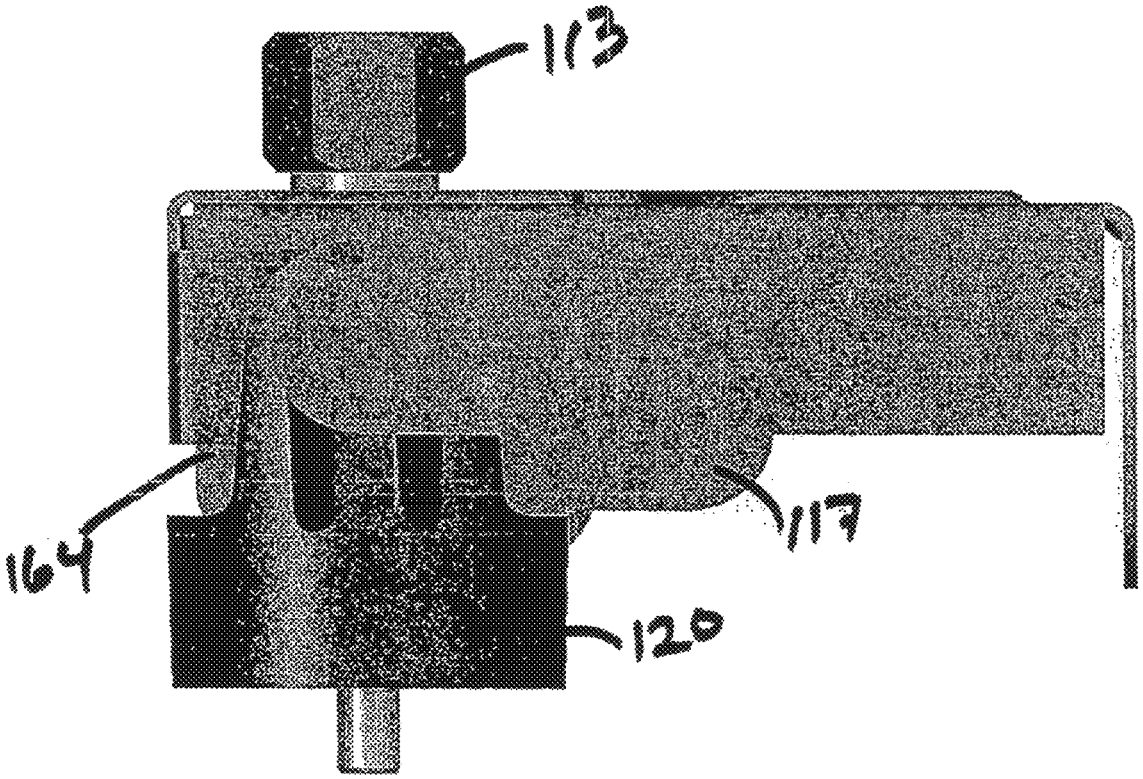
FIG. 31 is a side elevational view illustrating the rotatable connection of FIG. 28.
Figure 32:
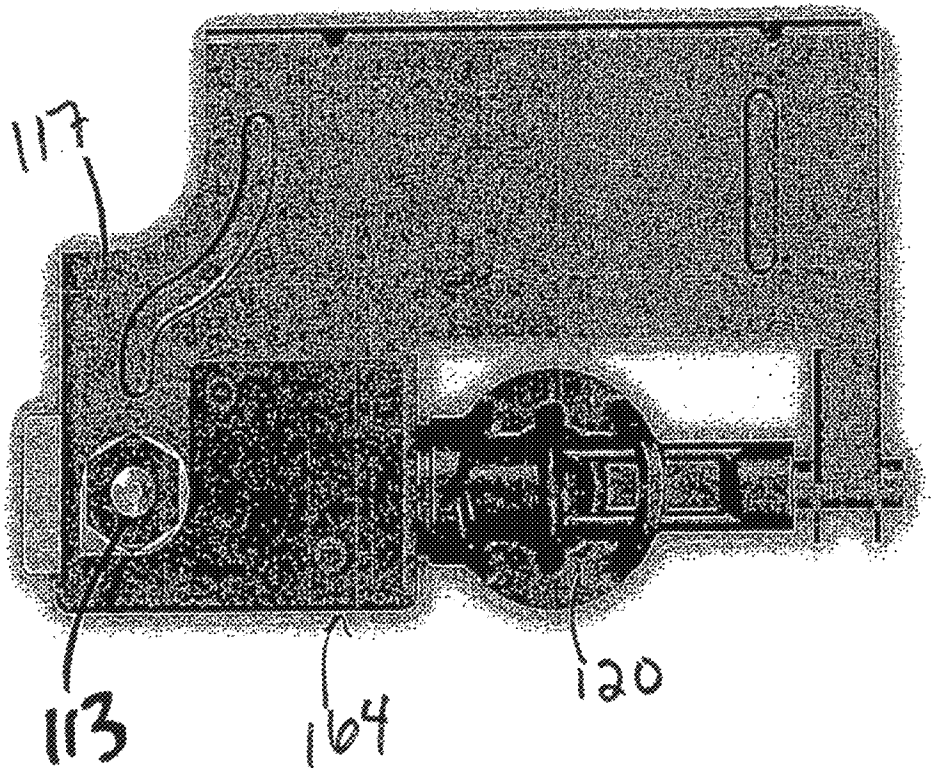
FIG. 32 is a top elevational view illustrating the rotatable connection of FIG. 28.
Figure 33:
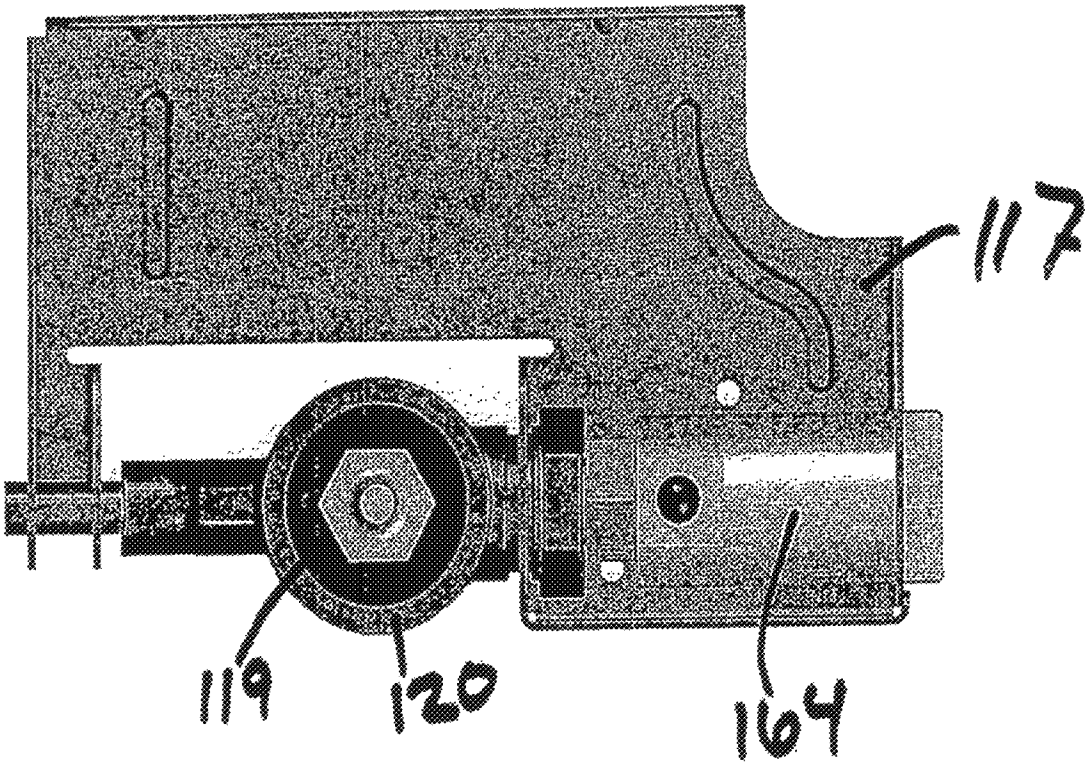
FIG. 33 is a bottom elevational view illustrating the rotatable connection of FIG. 28.

As illustrated in FIG. 28, fuel source 50, typically propane cylinders, is secured to the rotational connection by a threading engagement within tank fitting 120 and is held in position by sheet metal bracket 117 with pivot axis. Tank fitting 120 connects fuel source 50 to swivel body receiving connector 164, allowing the tanks to rotate to a predetermined angle from the heater. The swivel body used to employ the swivel connection will commonly determine the maximum angle the fuel source can rotate away from the heater, as rotation will be impeded by the design of the swivel body at a predetermined angle. Rotation ceases at receiver connector 164, which connects to fitting nut 113. Tank fitting 120 will preferably be rated to withstand a working pressure appropriate for the high pressure LP of the fuel source, typically approximately 150 psi. Commonly, at least one compression fitting is used to make the connection between fuel source 50 and swivel body receiving connector 164. FIGS. 28-33 illustrate fuel source 50 connected by tank fitting 120 to swivel body receiving connector 164 when removed from the heater.

Within tank fitting 120 is a sealing system, made of at least one O-ring 119 in one embodiment, so as to ensure a connection that will properly seal when pressurized LP is run through the fitting and connection into inlet fuel lines 115, leading into inline regulator 166. A check-valve (not shown) is located within tank fitting 120, or swivel body receiving connector 164, to ensure a proper connection exists between fuel source 50 and tank fitting 120. If the check-valve indicates a proper connection is not made, or a leak exists, fuel will not dispense into the heater until the connection is corrected. The pressure of a check valve within tank fitting 120 also permits operation of the unit with only one fuel source 50 attached.

Figure 34:
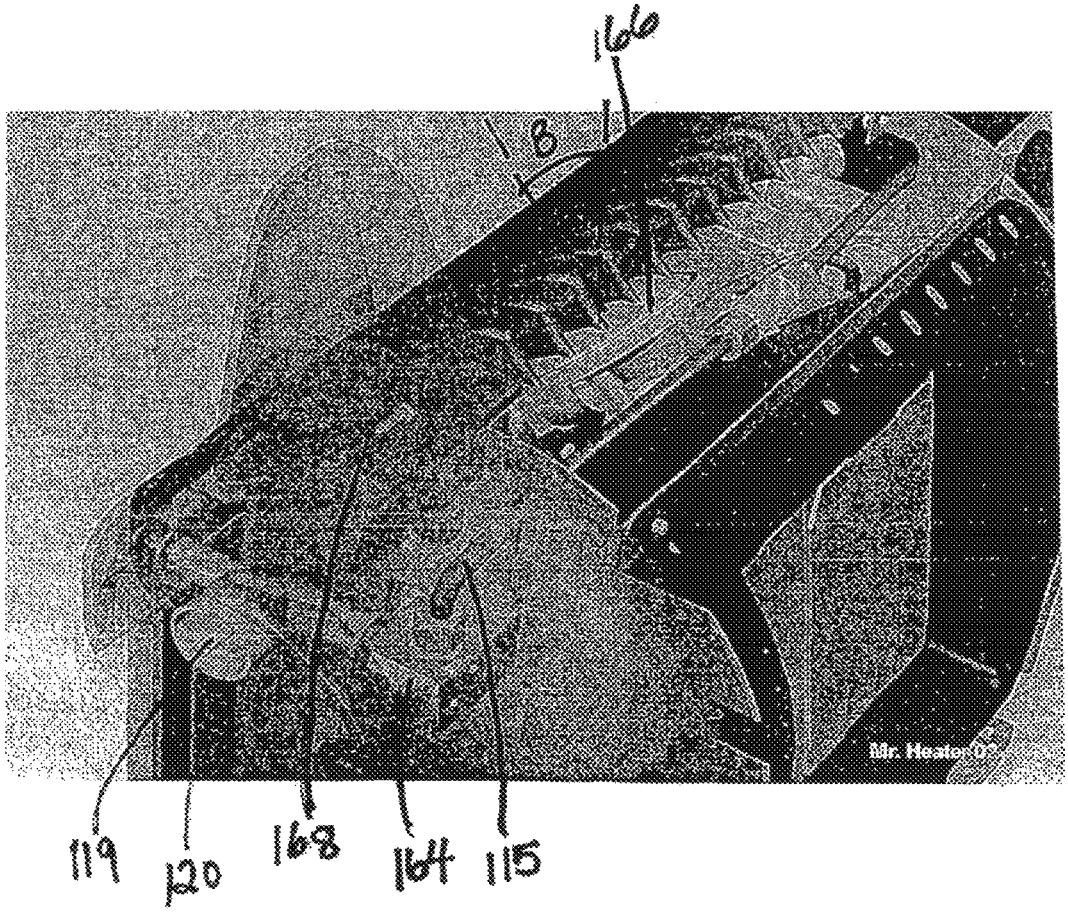
FIG. 34 is a side perspective view of an embodiment of a heater using the rotatable connection of a LP gas supply with top and side covers removed.

Pivotal movement is effected by rotatable fuel supply connection 120 feeding inlet fuel lines 115. Fuel lines 115 connect to single stationary inline regulator 166, which reduces the delivery pressure of the fuel, as shown in FIG. 26. Inline regulator 166 is typically located within the housing in the previously unused space near the upper rear portion of the heater. Regulator 166 is not limited, however, to this location within the housing of the heater, and can be located in any volume within the housing as space permits, as long as regulator 166 is stationary. It is preferable that the regulator is centrally located when more than one fuel supply is used, as the fuel from both fuel supplies run through the single inline regulator, however it is foreseen in one alternative embodiment that each fuel supply may use a separate stationary regulator. The position of the at least one regulator is only limited by the housing of the heater, and can be positioned on a substantially vertical plane, a substantially horizontal plane, or can be tilted on an angled plane, one example of which is shown in FIG. 34. In further embodiments of the heater, the stationary regulator may also be located exterior to the housing of the heater, and may be enclosed in a separate housing. Outlet fuel lines, such as outlet line 168 transport the fuel from regulator 166 to valve and office 56 (shown in FIGS. 1-2).

Figure 4:
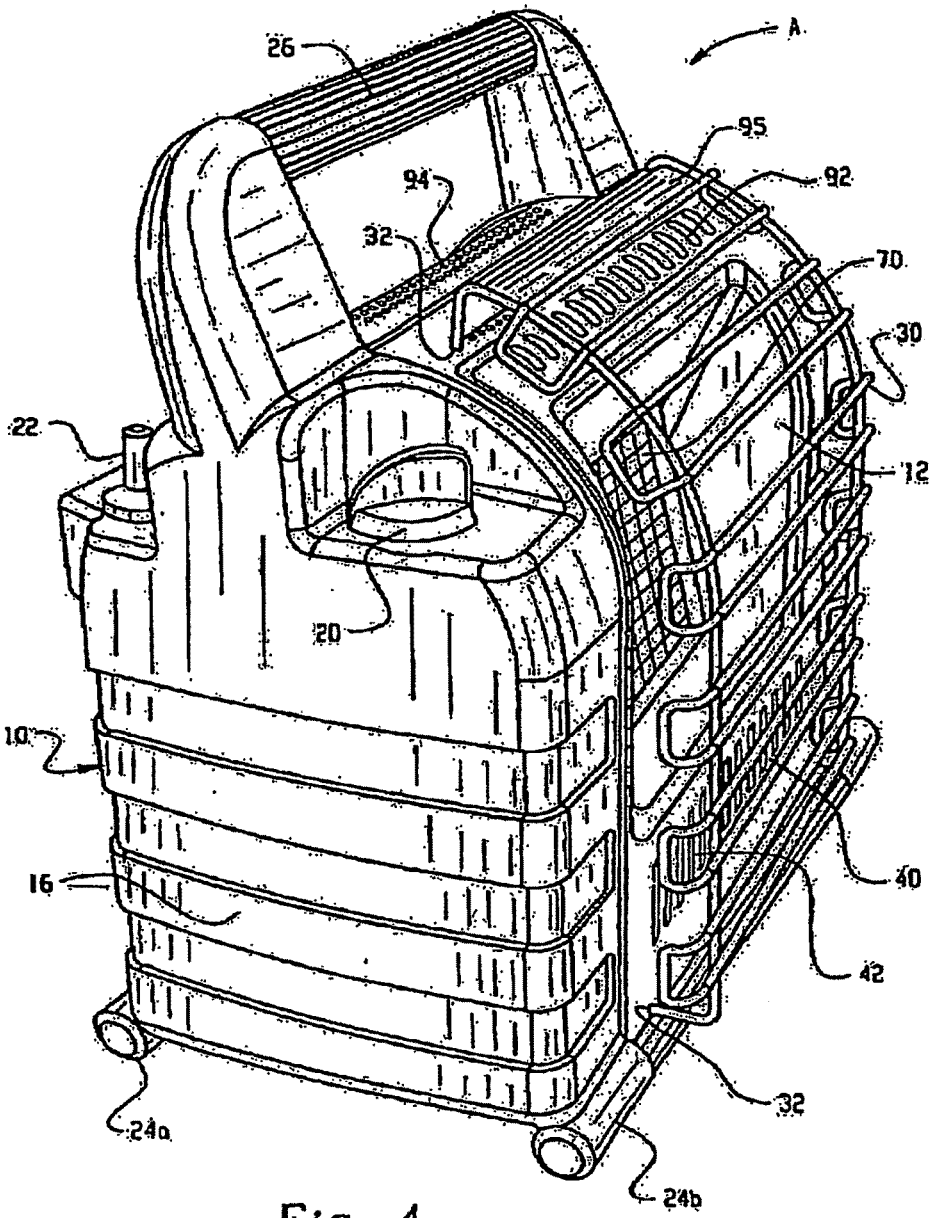
FIG. 4 is a perspective view of the heater taken generally from the front and left hand side.
Figure 20:
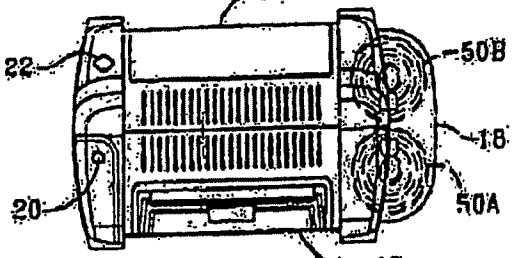
FIG. 20 is a top elevational view of a portable heater in accordance with an embodiment of the present invention with a handle and front grill removed to show two fuel sources positioned about one side of the heater.
Figure 21:
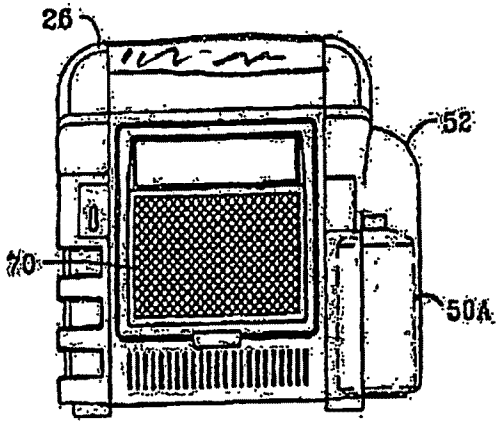
FIG. 21 is a front elevational view of a portable heater of FIG. 20 showing a front fuel source in ghost lines.

FIGS. 20-27 illustrate yet another embodiment of the invention in which more than one fuel source is positionable within the housing. As illustrated in FIG. 20, two fuel sources 50*a*, 50*b* are positioned within side wall 18 and at least partially covered by dome-shaped shoulders, and in one aspect, completely enclosed therein as illustrated in FIG. 21. Temperature controller button 20 and igniter button 22 are positioned similarly to that shown previously in FIG. 4.

Figure 22:
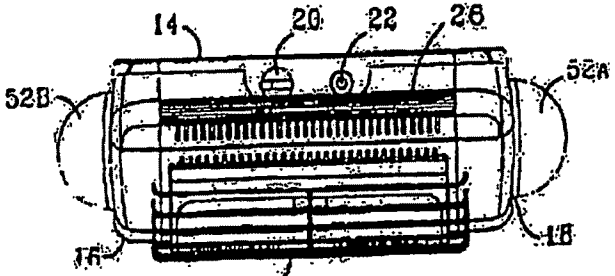
FIG. 22 is a top elevational view of an embodiment of a heater according to the present invention illustrating two fuel sources positioned about opposed sides of the heater.
Figure 23:
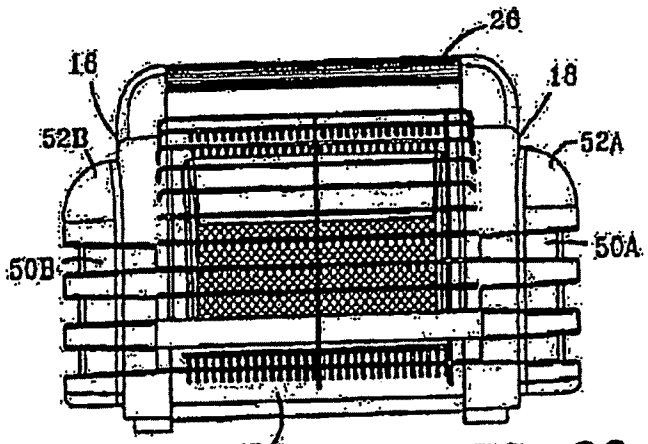
FIG. 23 is a front elevational view of the embodiment shown in FIG. 22 illustrating the fuel sources enclosed within a slotted enclosure.

In FIGS. 22-23, two fuel sources 50*a*, 50*b* which are at least partially enclosed by dome-shaped side panels 52*a*, 52*b* are positioned on opposed sides 18, 16 of heater housing 10. In this particular embodiment, the units are connected by a mixing valve (not shown) and the temperature controller button 20 and igniter button 22 operate to control a single burner unit.

Figure 24:
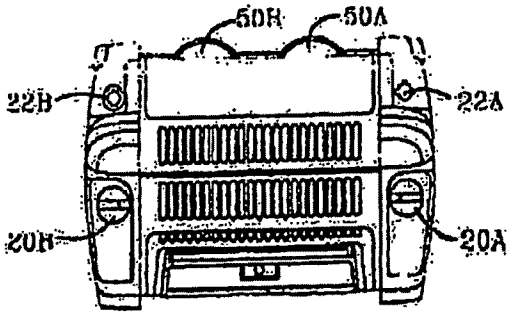
FIG. 24 is a top elevational view of an embodiment of a heater according to the present invention with handle and front grill removed illustrating two fuel sources positioned at the rear of the heater and partially protruding through the rear wall of the heater.
Figure 25:
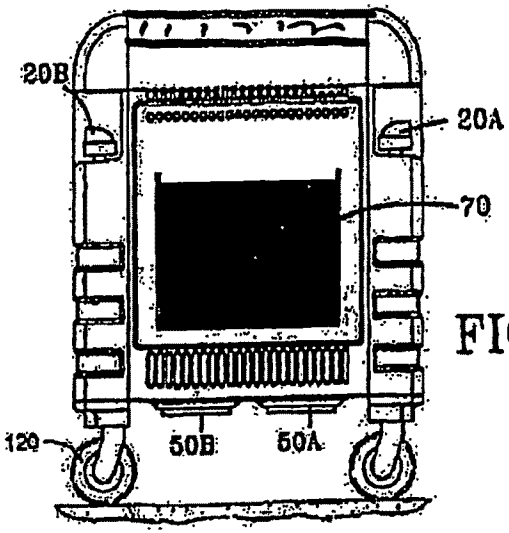
FIG. 25 is a front elevational view of the embodiment shown in FIG. 24.

In FIGS. 24-25, two fuel sources 50*a*, 50*b* are once again shown, the canisters protruding at least partially from the rear 14 of heater housing 10. As illustrated in this embodiment, each fuel source has its individual temperature controller buttons 20*a*, 20*b* and igniter buttons 22*a*, 22*b* for controlling the temperature of heater A.

It is recognized that when dual fuel source applications are discussed, it is recognized that the heat capacity of each burner need not be the same, and it is within the scope of this invention that different capacity burners are envisioned. For maximum heat control by the end-user, it is within the scope of the invention that one burner will be for "low" capacity applications and wherein the second burner will be for "high" capacity applications, and wherein the two burners can be used in combination to produce yet a higher capacity unit. For other applications, there will be two "low" capacity burners employed within one unit as well as applications where there will be two "high" capacity burners employed within the same unit. Optionally, there are applications wherein each burner (if each burner has a separate control) or a combined controller where each burner is commonly controlled) will have an associated "low", "medium" and "high" setting to permit still further refinements in the heat provided by the device. Additionally, it is envisioned that the heating device will have a single controller and one burner, the controller/burner combination having "low", "medium" and "high" settings. In a more expensive version of the heater, two continuously variable burners will be employed, such variability predicated by the rate at which fuel and/or air is supplied to the burners as well as the capacity of the burners, although it is envisioned that a single continuously variable burner is within the scope of this invention.

Figure 27:
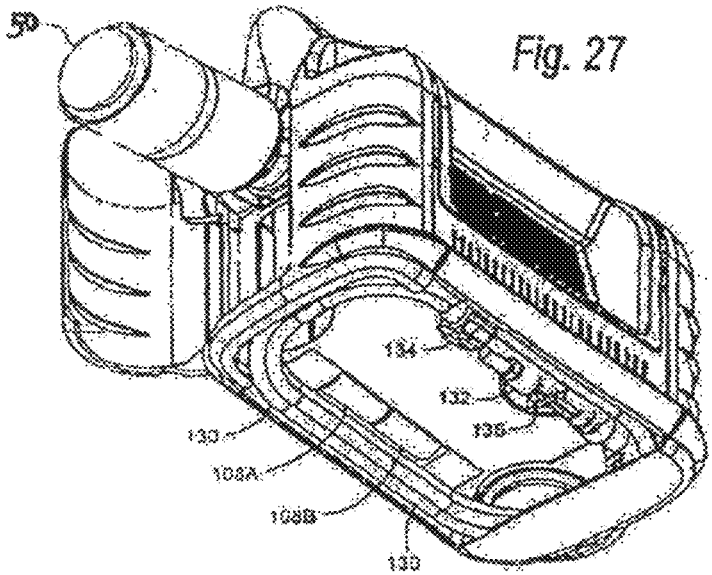
FIG. 27 is a bottom perspective view of an embodiment of an optional remote LP gas supply hose in a coiled configuration.

It should be noted that in embodiments of this invention in which more than one fuel source is illustrated, that the fuel sources can either be operated in tandem or individually. When operated in tandem, a mixing valve is included prior to the burner. In some embodiments of the invention, the second location of the fuel source is that of a storage capacity only, and the unit operates as previously described. It should also be noted that the handle 26 illustrated in many of the embodiments, is often optional, and that a heater which achieves portability by the incorporation of wheels 120 positioned at the bottom of the unit, better illustrated in FIG. 27 is within the scope of this invention or wherein the portability is associated with the incorporation of a wheeled dolly-like apparatus. When the wheels are of fairly small size, the number of wheels is at least three, preferably four and they are pivotable about a vertical axis. When the number is three, the wheels are positioned in a triangular fashion with two wheels at opposed ends on one side, and a third wheel in the middle of the unit on an opposed side. When the number is four, the wheels are positioned at the vertices of the base of the unit. In a specialized configuration, the number of wheels can be reduced to two. When used in this manner, the wheels are more similar to rollers and occupy at least 50% of the width of the base, preferably more and extending essentially across a complete side, on both sides of the unit.

Figure 35:
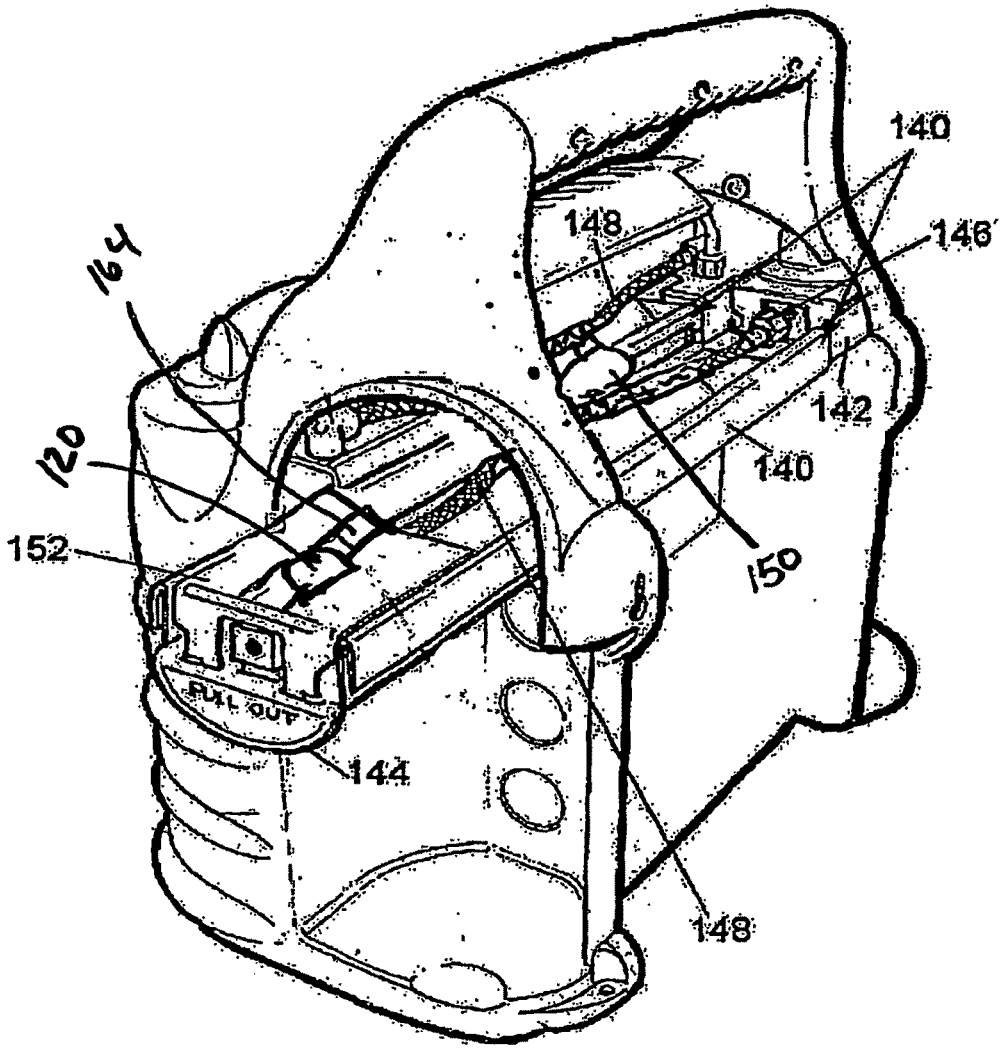
FIG. 35 is a side perspective view of an embodiment of a heater including an attachment mechanism for receiving two fuel sources illustrating a sliding track arrangement for the fuel source connection in conjunction with a flexible braided hose, the heater housing having the enclosing shroud or enclosure removed.

Alternative embodiments of the modes of attachment of the fuel supply are illustrated in FIGS. 35-39. FIG. 35 illustrates an alternative embodiment of the swivel connection showing slide channels 140, 142 which contain sliding brackets 152 into which are positioned tank fitting 120 and swivel body 164. Flexible gas hose 148, associated tank fitting 146, inline regulator 150, and other hardware secure interconnection between the fuel supply (not shown) and the burner assembly. A convenient pull-tab 144 is optionally incorporated into each bracket 152.

Figure 36:
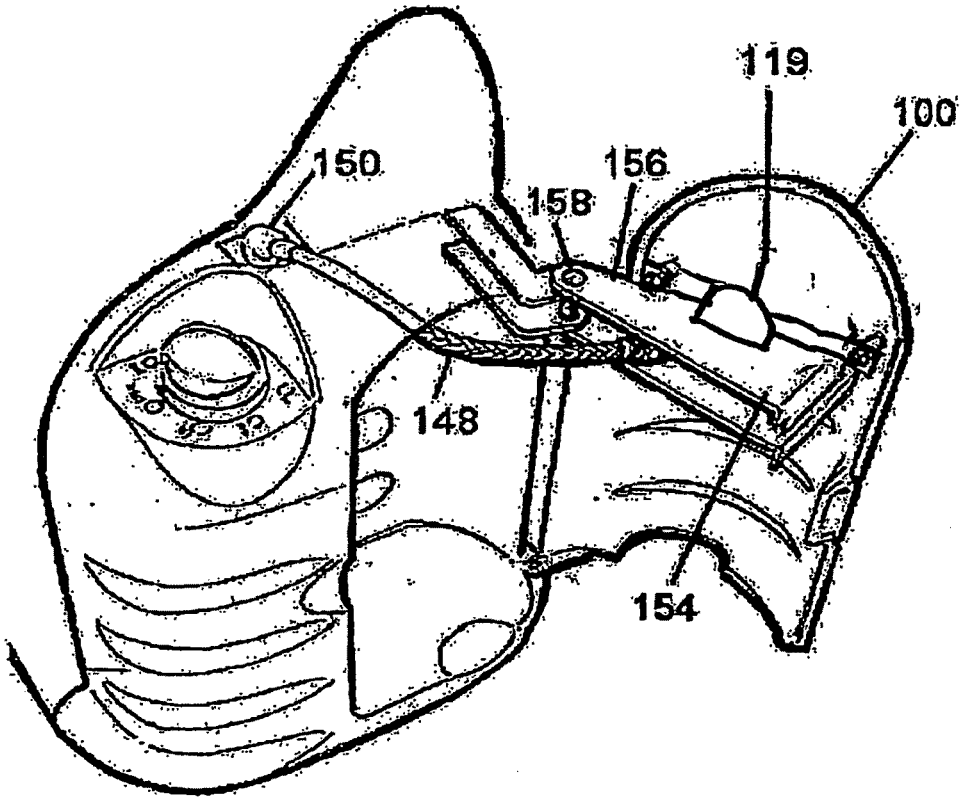
FIG. 36 is a side perspective view of an embodiment of a portion of a portable heater illustrating a fixed fuel regular positioned within a pivotal door of the housing in conjunction with a flexible braided hose.

FIG. 36 illustrates yet another alternative embodiment to the swivel gas connector in which swivel connection 119 swings out through its fixed positioning within bracket 154 affixed to hinged 158 door assembly 100 by bracket channel 156. In a manner similar to that described previously with FIG. 29, flexible gas hose 148 is used to interconnect between tank fitting (not shown) and inline regulator, which remains within the housing of the heater, as opposed to swinging outwards with door assembly 100, to secure interconnection between the fuel supply (not shown) and the burner assembly.

Figure 37:
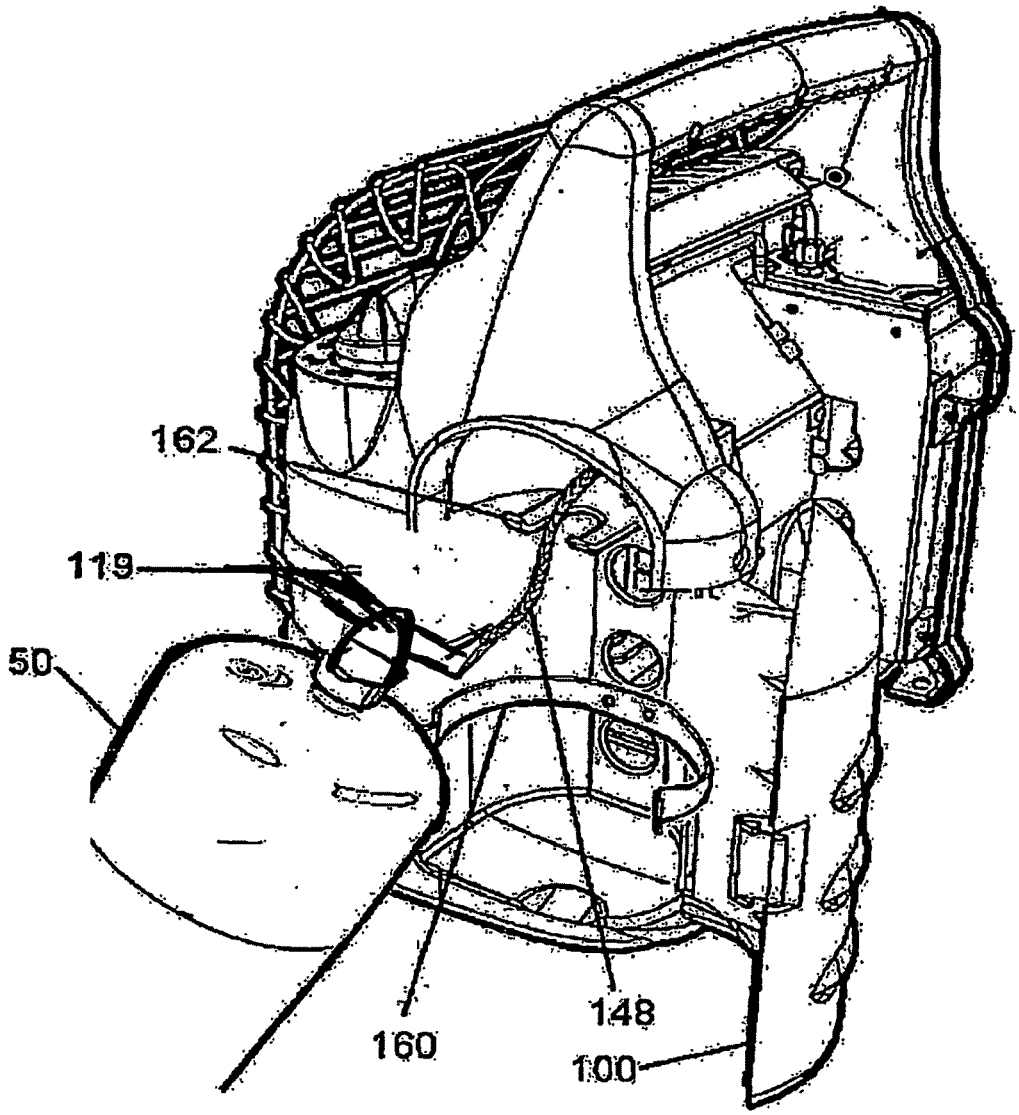
FIG. 37 is a side perspective view of an embodiment of the attachment for the fuel source illustrating a movable fuel tank fitting attached by a flexible house with a clip arrangement within the housing for cylinder positioning and retention.

FIG. 37 illustrates yet a further alternative embodiment for the convenience of removing the fuel supply and illustrates an arrangement wherein fuel source 50 with swivel connection 119 affixed thereto is positionable within the housing by an inwardly biased resilient spring clip 160 for fastening engagement about a middle of the fuel source and a second U-shaped bracket 162 fixedly attached to the heater housing for positioning about a neck of the fuel source. In a manner similar to that described previously, flexible gas hose 148 is used to interconnect between inline regulator 146 (not shown) and gas line fitting (not shown) to secure interconnection between fuel supply 50 and the burner assembly.

Figure 38:
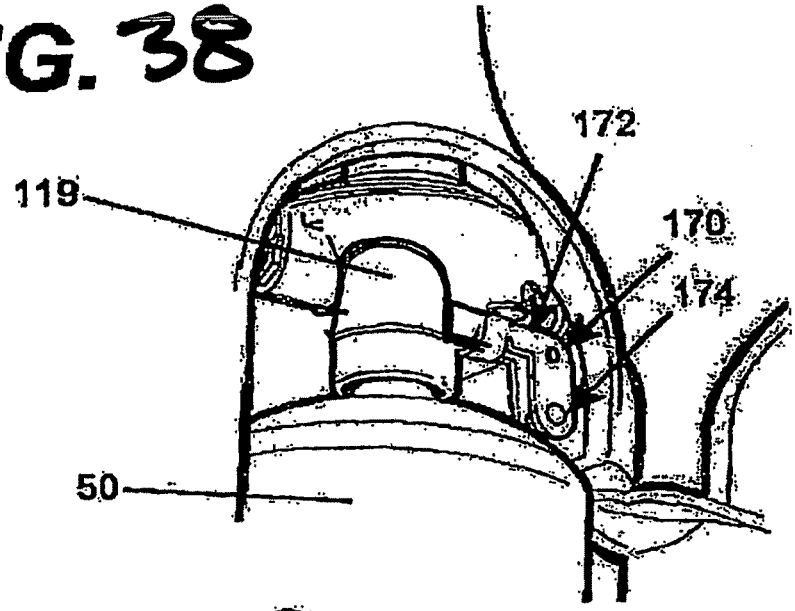
FIG. 38 is a side perspective view of an embodiment of a fuel source connection illustrating a pivotal weighted clip.
Figure 39:
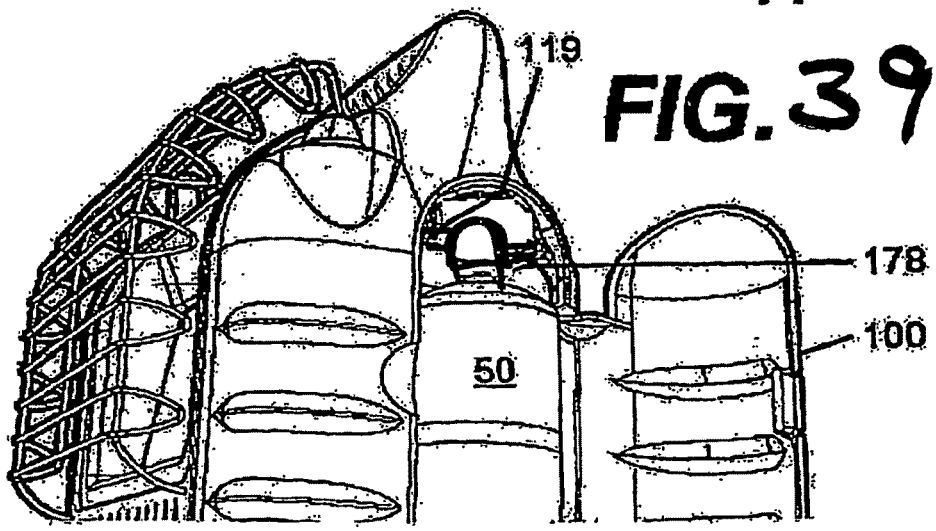
FIG. 39 is an enlarged side perspective view of the rotating clip of FIG. 38.

FIGS. 38 and 39 illustrate still yet a further alternative embodiment for the locking of the swivel connection of the fuel source and illustrates an arrangement wherein swivel body 119 is additionally equipped with rotating clip 172 with weight 174 positioned about a terminal edge. When the heater is in its up-right position 170 as illustrated in FIG. 38, clip 172 prohibits swivel body 119 from rotating. When the heater is positioned on its back side, the clip swings back into a second position 178 due to the gravitational effects upon weight 174 thereby swinging out of the way and allowing pivotal movement of the tank for changing thereof. With the incorporation of a weighted clip, the rotating feature for tank installation and removal is effected without changing the elevation of the tank as it moves from a first angular position to a second angular position.

Therefore, what has been shown and illustrated is a portable heating device in which the fuel source (typically at least one, and preferably two one pound cylinders) are moveable from a first use position into a second position in which the fuel source is replaced. The at least one fuel source connects to a swivel body which connects to an associated regulator (for decreasing the pressure of the exit port gas). This mode of operation in one embodiment is effected through the incorporation of a braided gas hose which employs a sliding mechanism in which the user physically pulls the cylinder from its use position inside the housing, to a replace position outside of the housing via telescoping or sliding movement of rails. In a second embodiment, this mode of operation is effected by the fixed incorporation of the swivel body into a door in the housing within which is positioned the fuel source, thereby requiring the user to open the door with cylinder attached for replacement of the cylinder. In a third embodiment, this mode of operation is effected by removal of the fuel source from within the housing which is attached by a clamp and bracket within the housing while in a fourth embodiment, this mode of operation is effected by pivotal movement of a swivel body within a pair of U-shaped clamps having a pivot rod interposed therebetween. In yet a fifth embodiment, this mode of operation is effected by a swivel weighted clip which requires tilting of the heater prior to removal of the spent fuel cylinder.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the invention is by way of example, and the scope of the invention is not limited to the exact details shown or described.

This invention has been described in detail with reference to specific embodiments thereof, including the respective best modes for carrying out each embodiment. It shall be understood that these illustrations are by way of example and not by way of limitation.

Additionally, it will be apparent to those skilled in the art that the above illustrative embodiments of the devices and methods may incorporate changes and modifications without departing from the general scope of this invention. It is intended to include all such modifications and alterations in so far as they come within the scope of the appended claims.

What is claimed is:

1. A portable radiant heater supplied by an associated fuel source comprising:

a housing having a handle for transporting the heater;

a plenum in the housing for receiving fuel from the associated fuel source and mixing fuel with air;

a burner assembly having a radiant surface that communicates with the plenum;

a regulator for limiting the pressure of the associated propane source to approximately eleven inches water column;

an oxygen depletion system associated with the burner assembly for automatically shutting off the heater at a predetermined oxygen content; and a tank fitting with a position that can be adjusted relative to the regulator to facilitate the installation of the associated fuel source to the heater.

2. The portable radiant heater according to claim 1, wherein the regulator is coupled to the heater at a fixed position relative to the housing.

3. The portable radiant heater according to claim 1, wherein the tank fitting is pivotally coupled to a bracket to pivot about a transverse axis relative to the bracket.

4. The portable radiant heater according to claim 3, wherein the bracket is slidable along a track to be selectively withdrawn from, and introduced into the housing for exposing the tank fitting externally of the housing and facilitating installation of the associated fuel source.

5. The portable radiant heater according to claim 3 further comprising a fitting nut that is stationary relative to the housing to which a fuel-carrying conduit is coupled to establish fluid communication between the pivotal tank fitting and the regulator.

6. The portable radiant heater according to claim 5, wherein the fuel-carrying conduit is a flexible fuel hose.

7. The portable radiant heater according to claim 1 further comprising a plurality of tank fittings with a position that can be adjusted relative to the regulator to facilitate the installation of a plurality of associated fuel sources to the heater.

8. The portable radiant heater according to claim 7, wherein at least one tank fitting is disposed adjacent to each lateral side of the heater and the regulator is separated approximately equidistantly from the at least one tank fitting adjacent to each lateral side.

9. The portable radiant heater according to claim 7, wherein the regulator is stationary relative to the housing and each tank fitting can be adjusted relative to the housing of the heater.

10. The portable radiant heater according to claim 9, wherein each tank fitting is pivotally coupled to the housing to pivot about a transverse axis relative to the housing.

11. The portable radiant heater according to claim 1, wherein each tank fitting is pivotally coupled to a door for concealing the associated fuel source to pivot about a transverse axis relative to the door.

12. The portable radiant heater according to claim 1, wherein the tank fitting is pivotally coupled to a door for concealing the associated fuel source to pivot about a transverse axis relative to the door.

13. The portable radiant heater according to claim 1, wherein the tank fitting can be removed from the releasable bracket while remaining coupled to a flexible fuel line that transports fuel from the associated fuel source to be delivered to the regulator.

14. The portable radiant heater according to claim 1, wherein the oxygen depletion system shuts off gas flow at approximately 18% by volume oxygen content.

15. The portable radiant heater according to claim 1 further comprising an ignitor for igniting fuel in the burner assembly.

16. A portable heater supplied by an associated propane source, comprising:

a housing;

an air inlet in said housing;

a valve adapted to receive fuel from the associated propane source;

a burner assembly adapted to operatively communicate with the associated propane source and said air inlet;

a controller adapted to control said burner assembly to permit refinement in the heat provided from the burner, wherein said controller is adapted to, permit adjustment to at least three discrete levels of heat for which the burner is adapted to provide, or permit adjustment along a continuum of the levels of heat for which the burner is adapted to provide;

a radiant surface, said radiant surface comprising a rear face;

an automatic shutoff adapted to, measure the amount of carbon monoxide within the atmosphere, and shut off the portable heater at a predetermined amount of carbon monoxide within the atmosphere;

a regulator, said regulator internal to said housing, in operational connection with said valve, and being adapted to limit the pressure of the fuel to approximately eleven inches water column;

fuel lines in fluid communication with said regulator and said valve; and a plurality of swivel connectors, each of said swivel connectors comprising, a bracket defining an axis, and a pivotable fuel source connection comprising a tank fitting, said pivotable fuel source connection being, rotatably coupled to the bracket to rotate with respect to the regulator and about the axis, in fluid communication with the regulator, and adapted for threadable engagement and fluid communication with said associated propane source.

* * * * *